US005854465A

United States Patent [19]

Kishi et al.

[11] Patent Number: 5,854,465

[45] Date of Patent: Dec. 29, 1998

[54] THERMAL FIXING DEVICE FOR AN IMAGE FORMING APPARATUS

[75] Inventors: Kazuhito Kishi, Yokohama; Takeshi Takemoto, Yamato; Takashi Kimura, Yokohama, all of Japan

[73] Assignee: Ricoh Company, Ltd., Tokyo, Japan

[21] Appl. No.: 531,003

[22] Filed: Sep. 20, 1995

[30] Foreign Application Priority Data

| | | | |
|---|---|---|---|
| Sep. 21, 1994 | [JP] | Japan | 6-226677 |
| Oct. 11, 1994 | [JP] | Japan | 6-245648 |
| May 31, 1995 | [JP] | Japan | 7-134098 |

[51] Int. Cl.[6] ..... G03G 15/20

[52] U.S. Cl. ..... 219/216; 399/331

[58] Field of Search ..... 219/216, 469–471; 399/330–334; 432/60; 492/46

[56] References Cited

U.S. PATENT DOCUMENTS

| | | | |
|---|---|---|---|
| 3,720,808 | 3/1973 | Morrissey | 219/469 |
| 4,377,335 | 3/1983 | Fannon et al. | 219/216 |
| 4,535,230 | 8/1985 | Brieu | 219/470 |
| 4,544,828 | 10/1985 | Shigenobu et al. | 219/216 |
| 4,637,109 | 1/1987 | Bryer | 492/10 |
| 5,115,279 | 5/1992 | Nishikawa et al. | 219/216 |
| 5,280,329 | 1/1994 | Akiyama et al. | 219/216 |
| 5,303,016 | 4/1994 | Oda et al. | 219/216 |

FOREIGN PATENT DOCUMENTS

| | | | |
|---|---|---|---|
| 562461 | 5/1975 | Switzerland | 219/216 |

*Primary Examiner*—Teresa J. Walberg
*Assistant Examiner*—J. Pelham
*Attorney, Agent, or Firm*—Oblon, Spivak, McClelland, Maier & Neustadt, P.C.

[57] ABSTRACT

In a thermal printing device for an image forming apparatus, a heat generating member is implemented as a hollow heat roller having a heating layer thereon. A first member is disposed in the hollow heat roller while. A press roller or second pressing member is located outside of the heat roller while at least partly corresponding to the heat roller. A biasing mechanism biases at least one of the pressing member and press roller toward the other, so that the heat roller is pressed against the pressing member o r the press roller. The device reduces a warm-up time and generates a desired amount of heat with a minimum of power.

94 Claims, 18 Drawing Sheets

Fig. 21A
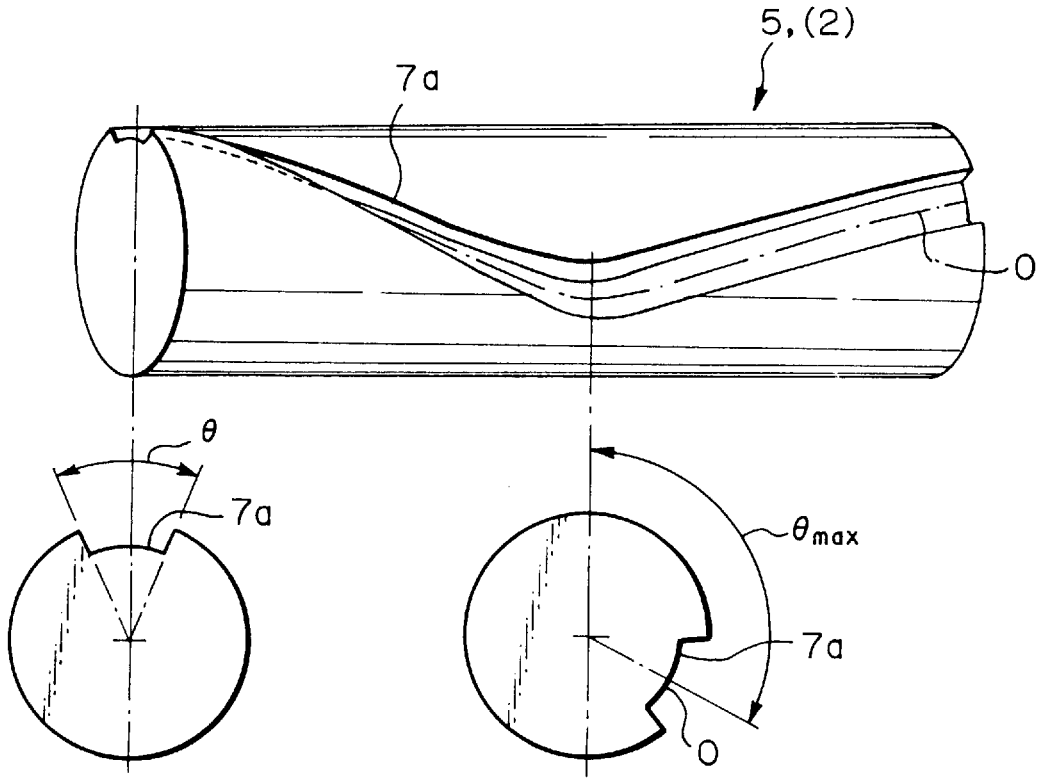
Fig. 21B Fig. 21C
Fig. 22
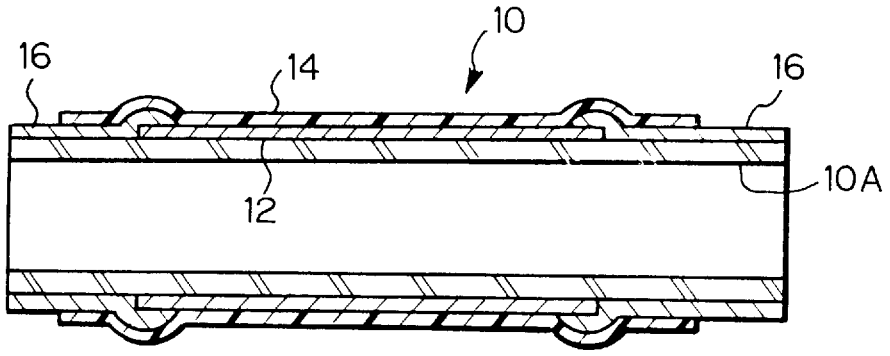

THERMAL FIXING DEVICE FOR AN IMAGE FORMING APPARATUS

FIELD OF THE INVENTION

BACKGROUND OF THE INVENTION

The present invention relates to a thermal fixing device for a copier, facsimile apparatus, printer or similar image forming apparatus.

DISCUSSION OF THE BACKGROUND

It has been customary with an image forming apparatus to use a fixing device of the type having a heat roller and melting a developer or toner deposited on a paper by heat. Typical of this type of fixing device is one having a heat roller accommodating a halogen lamp therein, and a press roller held in pressing contact with the heat roller. When a paper is passed through a nip between the heat roller and the press roller, a developer deposited on the paper is melted at the nip by heat generated by the halogen lamp.

The problem with the thermal fixing device is that several minutes are necessary for the heat roller to be heated to a temperature high enough to melt the developer, resulting in a long warm-up time. Hence, in order to reduce the interval between the start of manipulation and the start of actual recording (copying or printing), power must be continuously fed to the halogen lamp even in a stand-by condition. Although this maintains the heat roller at a preselected temperature at all times, the power consumption of the image forming apparatus is aggravated because the ratio of the power consumption in the stand-by condition to the total power consumption of the image forming apparatus is great.

In light of the above, the press roller may be implemented as a hollow member in order to reduce its thermal capacity, as proposed in, e.g., Japanese Utility Model Laid-Open Publication No. 6-25850. The reduced thermal capacity promotes the rapid temperature elevation of the surface of the press roller. However, because the surface of the press roller is also heated via the heat roller, the temperature elevation time of the press roller cannot be reduced to such a degree that the power supply to the heat roller in the stand-by condition is needless.

Japanese Patent Laid-Open Publication No. 64-86185, for example, discloses a thermal fixing device including a heat roller having a heating element on its surface. Specifically, a heating layer is formed on a roller or pipe made of phenol resin, glass, alumina ceramics, or stainless steel. Electrodes are connected to opposite ends of the heating layer. Further, an insulating layer is formed on the surface of the heating layer. The above document teaches that when an enameled aluminum pipe is used and has a wall thickness of 0.5 mm to 1.5 mm, its temperature rises to, e.g., 180° C. in less than 10 seconds. In this configuration, heat is generated on the surface of the heat roller. This increases the heating efficiency and thereby reduces the warm-up time to a noticeable degree. However, reducing the thermal capacity of the base of the heat roller is an effective approach to reduce the warm-up time to the degree which eliminates the need for the power supply in the stand-by condition.

In order to reduce the thermal capacity of the base, the volume of the heat roller may be reduced. For this purpose, the base may be reduced in diameter and wall thickness. However, for the efficient fixation of the toner on the paper, the press roller must exert a force on the heat roller which is great enough to set up a sufficient nip between the two rollers. Hence, when the volume of the base of the heat roller is simply reduced, the base is apt to bend excessively due to the force of the press roller, lowering the mechanical strength of the entire roller.

Japanese Patent Publication No. 63-249875 proposes a thermal fixing device having an extra roller holding a heat roller between it and a press roller. Although the extra roller reduces the bend of the heat roller, it brings about the following problem. Because the heat roller is sandwiched between the press roller and the extra roller, it needs a sufficient mechanical strength. When the base of the heat roller is reduced in wall thickness in order to reduce the heat capacity, as stated above, the heat roller breaks due to the forces of the press roller and extra roller. This kind of fixing device is not feasible for a high-speed machine.

As stated above, at the present stage of development, a thermal fixing device which warms up rapidly and has heating means strong enough to cope with a high-speed machine is not available.

Moreover, for the reduction of the warm-up time of the heat roller, it is necessary to increase the power to be applied to the heating element of the roller, i.e., the amount of heat to be generated thereby. Such an amount of heat causes the various constituents of the heat roller to expand. As a result, it is likely that the bond between the surface of the pipe and the heating layer is destroyed and causes the heating layer to come off. In addition, separation or cracking is also apt to occur between the heating layer and the electrodes. This also occurs between the heating layer and the pipe structure made of phenol resin, glass, alumina ceramics, or enamel.

SUMMARY OF THE INVENTION

It is, therefore, an object of the present invention to provide a thermal fixing device for an image forming apparatus and capable of warming up rapidly and thereby generating a desired amount of heat with a minimum of power consumption.

It is another object of the present invention to provide a thermal fixing device for an image forming apparatus which is low cost, durable, and desirable in warm-up characteristic.

In accordance with the present invention, a thermal fixing device has a hollow heat generating member having at least a heat generating layer, a first pressing member disposed in the heat generating member while at least partly corresponding to the heat generating member, a second pressing member located outside of the heat generating member and at least partly corresponding to the heat generating member, and a biasing member for biasing at least one of the first and second pressing members toward the other to thereby urge it against the first pressing member or the second pressing member.

Also, in accordance with the present invention, in a thermal fixing device having a heat roller made up of a glass pipe structure, a heat generating member formed on the surface of the glass pipe structure and having a heating element, and a protection layer for protecting the heat generating member, the heat roller satisfies the following relations at the same time:

$$W \leqq -6t+10 \quad (1)$$

$$W \geqq 3t+1 \quad (2)$$

$$t \geqq 0.2 \quad (3)$$

where t (mm) is the wall thickness of the glass pipe structure, and W (W/cm$^2$) is a power density to be applied t o the heat generating member.

BRIEF DESCRIPTION OF THE DRAWINGS

The above and other objects, features and advantages of the present invention will become more apparent from the following detailed description taken with the accompanying drawings in which:

FIG. 21 shows a seventeenth embodiment of the present invention;

FIG. 22 is a section showing an eighteenth embodiment of the present invention;

DESCRIPTION OF THE PREFERRED EMBODIMENTS

Preferred embodiments of the thermal fixing device in accordance with the present invention will be described with reference to the accompanying drawings.

1ST EMBODIMENT

Figure 1A:
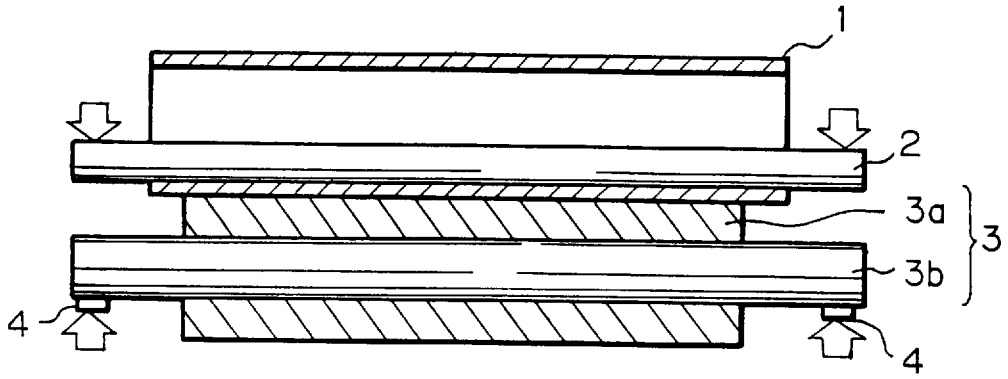
FIGS. 1A and 1B are sections showing a first embodiment of the thermal fixing device in accordance with the present invention.
Figure 1B:
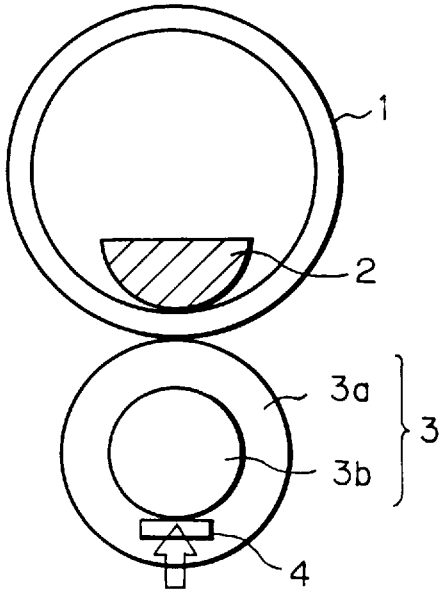

Referring to FIGS. 1A and 1B, a first embodiment of the fixing device is shown and has a hollow cylindrical heat roller, or heating member, 1 having a heating layer thereon. A pressing member, or first pressing member, 2 is disposed in the heat roller 1 while at least partly corresponding to the roller 1. A press roller, or second pressing member, 3 is positioned outside of the heat roller 1 while at least partly corresponding to the roller 1. Biasing means 4 urges at least one of the pressing member 2 and press roller 3 against the other in such a direction that the heat roller 1 is pressed against one of the pressing member 2 and heat roller 3. When the heat roller 1 is driven, the press roller 3 follows the movement of the roller 1 without deforming the roller 1. Hence, when a paper, not shown, carrying a toner image thereon is passed through a nip n between the rollers 1 and 3, the toner image can be fixed on the paper without being disturbed. The press roller 3 may be driven and cause the heat roller 1 to follow its rotation, if desired.

In the illustrative embodiment, the heat roller 1 may be made up of a metallic base and an insulating layer formed thereon. The insulating layer may be implemented as a ceramic layer, a heat-resistive high molecule layer, or an oxide film of Alumite or similar material formed on aluminum (Al), iron (Fe) or an alloy thereof. Alternatively, the heat roller 1 may have a base formed of glass, ceramics heat-resistive plastics or similar insulating material and provided with a tubular or belt-like hollow cylindrical configuration. In this case, a ceramic heating element or Nichrome, Ta2N, RuO2, Ag/Pd or similar heating element is sprayed, applied, printed or otherwise deposited on the insulative base in a planar pattern or in a stripe pattern. When a current flows through the heating element, the heat roller 1 generates heat. Further, use may be made of a ceramic heater or similar hollow cylindrical heating element, e.g., Infrarex Bark Heater available from Tokai Konetsu Kogyo (Japan).

The pressing member 2 may be formed of Fe, Al or similar metal having a high Young's modulus, or ceramics, plastics or similar nonmetal. Among them, Fe, Al and their alloy are desirable from the cost standpoint; the material should preferably have a low thermal conductivity. As shown in FIG. 1A, to facilitate the attachment of bearings to opposite ends of the member 2, the member 2 should preferably be longer than the heat roller 1 and protrude from the roller 1 at the opposite ends.

The press roller 3 is made up of a metallic core 3*b*, and a rubber layer 3*a* formed on the core 3*b* and implemented by, e.g., silicone rubber having a high parting ability. The press roller 3, located outside of the heat roller 1 and facing the pressing member 2, holds the roller 1 between it and the member 2. The biasing means 4 urges the press roller 3 against the heat roller 1 and is implemented by a leaf spring or similar pressing mechanism. In this configuration, both the pressing member 2 and the press roller 3 are held in close contact with the heat roller 1. The pressing member 2 and press roller 3 hold the heat roller 1 therebetween. The previously mentioned nip n is formed between the rollers 1 and 3.

The embodiment frees the heat roller 1 from deformation despite that the roller 1 has a hollow base. Hence, for the heating body, use can be made of a heat roller having a small thermal capacity. This reduces the heat elevation time or warm-up time of the heat roller 1 and thereby realizes a heating device which eliminates the need for preheating in a stand-by condition. As a result, the total power consumption of the device is noticeably reduced.

Further, to reduce the deformation of the heat roller 1, it has been customary to provide the roller 1 with a great outside diameter and thereby increase the sectional secondary moment. By contrast, the embodiment reduces the outside diameter of the roller 1 for a given degree of deformation. In addition, because the pressing member 2 for avoiding the deformation of the roller 1 is disposed in the roller 1, the overall construction is miniature, compared to the case where the member 2 is located outside of the roller 1. Hence, the fixing device has a mechanical strength great enough to withstand a high contact pressure particular to a high-speed machine.

Figure 2:
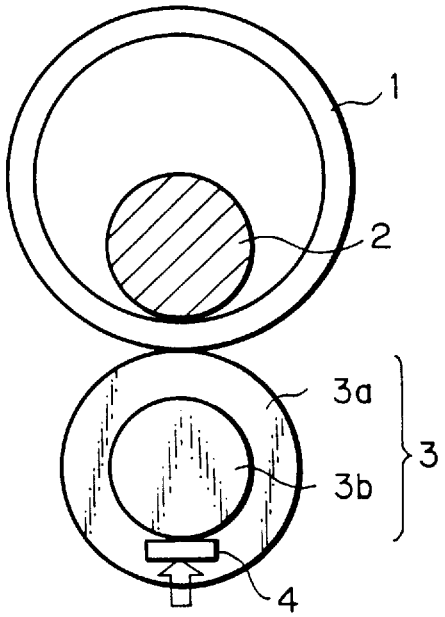
FIGS. 2 and 3 are sections each showing a particular modification of the first embodiment.

FIG. 2 shows a modified form of the pressing member 2. As shown, the pressing member 2 is configured as a freely rotatable roller. The modified configuration reduces friction acting between the pressing member 2 and the heat roller.

This successfully reduces the wear of the roller 1 and member 2 and thereby extends the life of the device. Moreover, metal powder attributable to the wear of the roller 1 and member 2 is prevented from noticeably disturbing a toner image. In addition, because the friction between the roller 1 and member 2 is reduced, the torque necessary for the drive of the roller 1 is reduced. As a result, a mechanism for driving the roller 1 is reduced in size, weight, and power consumption.

Figure 3:
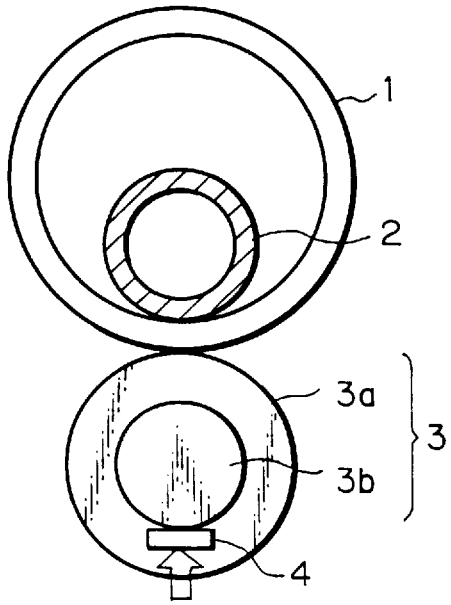

The pressing member 2 may further be implemented as a hollow cylinder, as shown in FIG. 3. For a given diameter, the cylindrical member 2 is more desirable than the hollow cylindrical member 2 in respect of bending strength. However, so long as the bending strength lies in an allowable range, the hollow member 2 is more preferable because it is light weight and small in thermal capacity. Because the hollow member 2 needs only a smaller thermal energy than the solid member 2 in reaching a preselected temperature, it allows the device to warm up in a short period of time and consume a minimum of power.

2ND EMBODIMENT

Figure 4A:
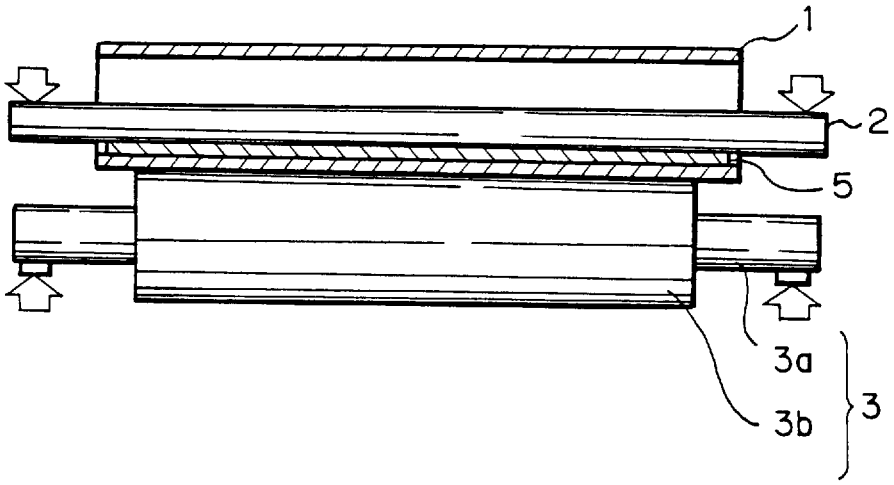
FIGS. 4A and 4B are sections showing a second embodiment of the present invention.
Figure 4B:
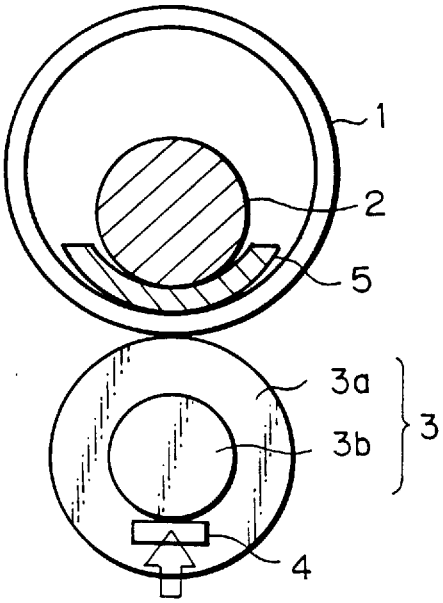

A second embodiment of the present invention will be described with reference to FIGS. 4A and 4B. As shown, a heat insulating member 5 is interposed between the pressing member 2 and the heat roller 1. The heat insulating layer 5 has a heat insulating layer formed of a material which is resistive to heat and lower in thermal conductivity than the pressing member 2, e.g., phenol resin or a similar resin, or asbestos. Preferably, the thermal conductivity of the member 5 should be lower than that of the heat roller 1. The member 5 extends in the axial direction of the heat roller 1, has a curvature portion smaller than the inside diameter of the inner periphery of the roller 1, and contacts the inner periphery of the roller 1. As shown in FIG. 4A, the member 5 is shorter than the heat roller 1 and is fully received in the roller 1. Alternatively, the member 5 may be longer than the heat roller 1 and protrude from opposite ends of the roller 1. When the heat roller 1 and press roller 3 are rotated, the member 5 slides on the roller 1.

In the above configuration, the heat insulating member 5 obstructs the transfer of heat from the heating body to the pressing member 2, so that the thermal energy generated by the heating element is effectively used. Hence, the embodiment further reduces the consumption of thermal energy, promotes the rapid temperature elevation of the heating element, and thereby saves power.

Figure 5:
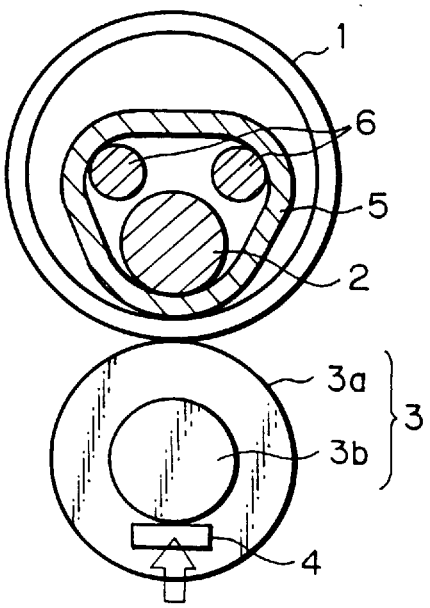
FIG. 5 is a section showing a modification of the second embodiment.

FIG. 5 shows a modified form of the heat insulating member 5. As shown, the member 5 has a tubular shape. The pressing member 2 is disposed in the tubular member 5 while at least partly corresponding to the member 5. When the member 5 is formed of a soft material, support members 6 are disposed in the member 5 and support it. It is to be noted that the support members 6 are omissible, depending on the material, shape and other factors of the member 5. When the heat roller 1 and press roller 3 are rotated, the member 5 is rotated at substantially the same linear velocity as the roller 1 at the position where it contacts the roller 1.

The freely rotatable tubular member 5 shown in FIG. 5 and the heat roller 1 contacting it wear little and extend the life of the product, thereby reducing the cost of the product. The decrease in the friction between the roller 1 and the member 5 allows the roller 1 to be driven by a minimum of torque. This miniaturizes the drive mechanism and thereby miniaturizes the overall device while saving power.

3RD EMBODIMENT

Figure 6A:
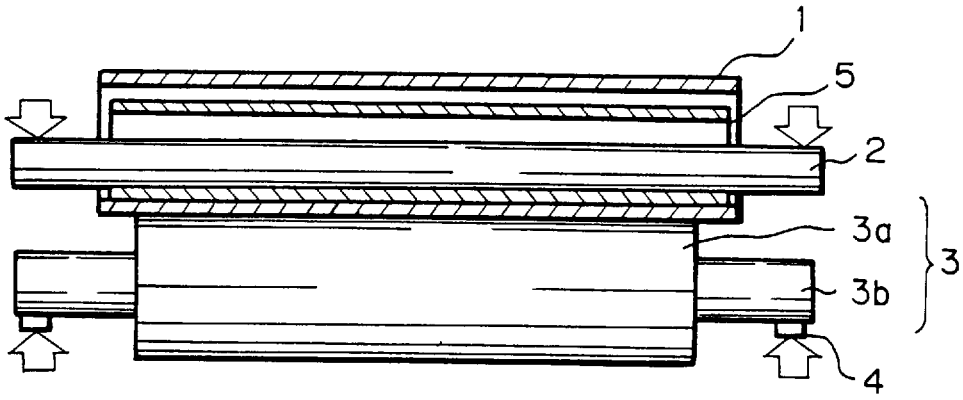
FIGS. 6A and 6B are sections showing a third embodiment of the present invention.
Figure 6B:
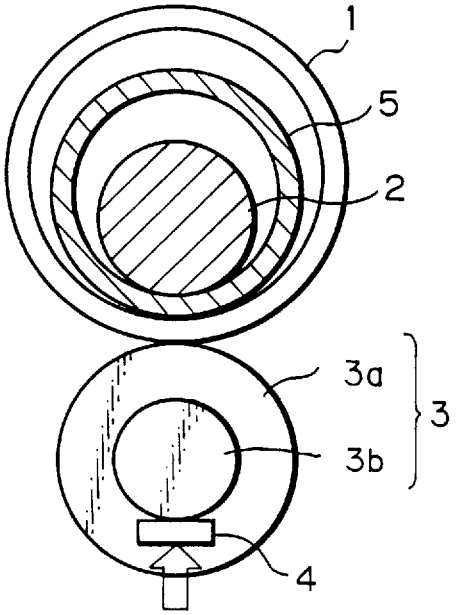

Referring to FIGS. 6A and 6B, a third embodiment of the present invention is shown in which the heat insulating member 5 is implemented as a hollow cylindrical rigid member. As shown, the member 5 has an outside diameter smaller than the inside diameter of the heat roller 1. The pressing member 2 is disposed in the member 5. The member 5, made of a rigid material capable of maintaining the shape by itself, does not need the support members 6, FIG. 5. When the heat roller 1 and press roller 3 are rotated, the member 5 is rotated at a linear velocity matching the linear velocity of the roller 1 at the position where it contacts the roller 1.

The rigid member 5 is easy to rotate and simple in configuration and, therefore, of low cost. In addition, because the member 5 is simple and rotates smoothly, a toner image is free from deterioration attributable to the vibration of the member 5.

4TH EMBODIMENT

Figure 7A:
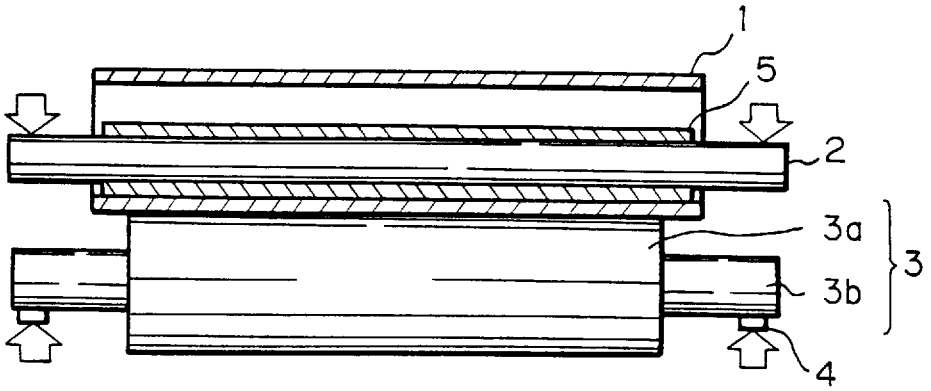
FIGS. 7A and 7B are sections showing a fourth embodiment of the present invention.
Figure 7B:
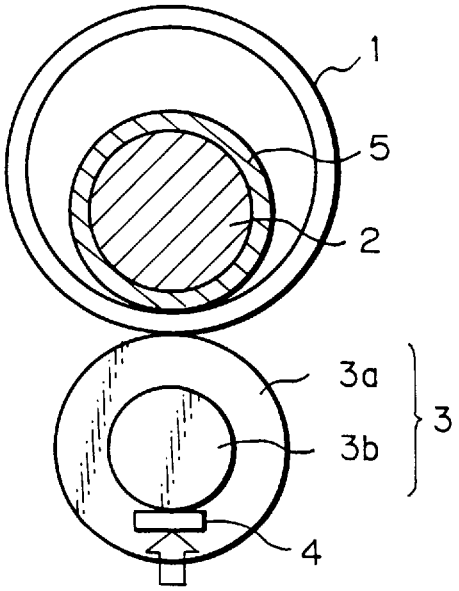

FIGS. 7A and 7B show a fourth embodiment in which the heat insulating member and pressing member 2 are constructed integrally with each other. As shown, the member 5 has an inside diameter equal to the outside diameter of the pressing member 2. The two members 2 and 5 are constructed into a single member, closely contacting each other. Specifically, the members 2 and 5 are joined together by adhesion or press-fitting. Alternatively, a heat insulating layer may be applied, sprayed, printed, vacuum-deposited, or otherwise formed on the member 2 beforehand.

In the illustrative embodiment, the pressing member 2, closely contacting the heat insulating member 5, can be provided with a greater diameter for a given inside diameter of the heat roller 1. Hence, the device is adaptive to a high-speed machine exerting a higher contact pressure. Furthermore, when the outside diameter of the member 2 is relatively small, the roller 1 can be provided with a smaller diameter relative to the member 5. This reduces the thermal capacity of the device and allows it to warm up more rapidly.

Figure 8:
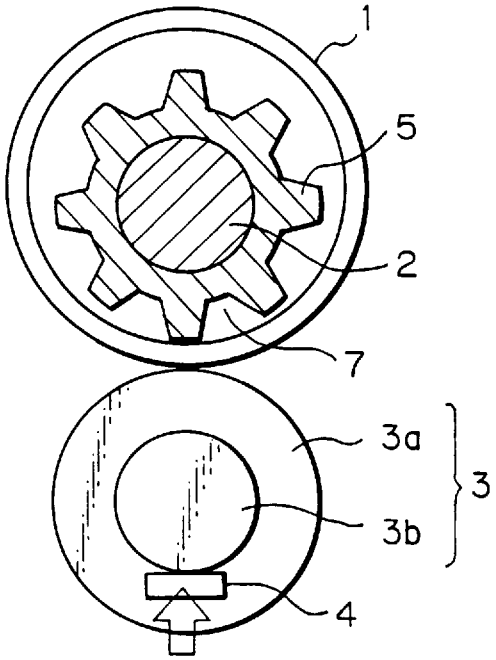
FIG. 8 is a section showing a modification of the fourth embodiment.

FIG. 8 shows a modified form of the fourth embodiment. As shown, the heat insulating member 5 is formed with spaces 7 in at least a part thereof. The spaces 7 are formed in the inside of the member 5 or on the surface of the member 5 as illustrated. When the spaces 7 are formed in the inside of the member 5, they are implemented as bubbles or tubes. When the spaces 7 are formed on the surface (inner periphery or outer periphery) of the member 5, they are implemented as recesses or holes. The spaces 7 allow a gas lower in thermal conductivity than solids and liquids to exist therein, thereby reducing the thermal energy to leak from the heating portion.

With the above configuration, the embodiment further reduces the energy necessary for the heating element to reach a preselected temperature, thereby enhancing the rapid warm-up of the device and reducing power consumption.

5TH EMBODIMENT

Figure 9:
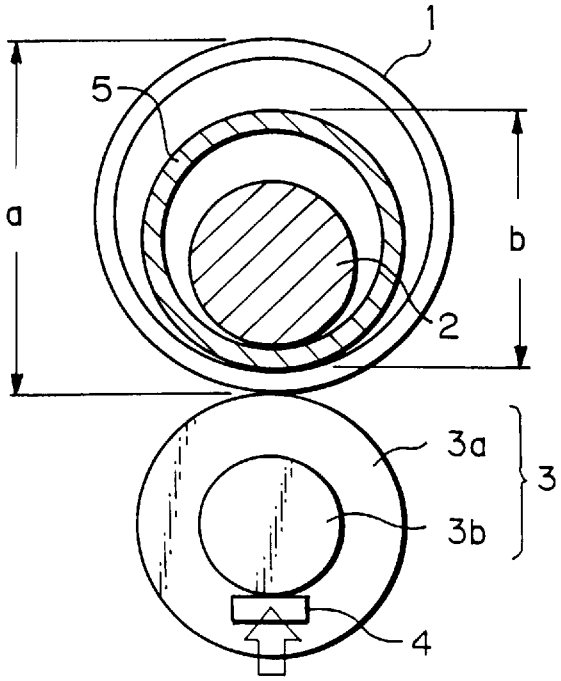
FIG. 9 is a section showing a fifth embodiment of the present invention.

A fifth embodiment of the present invention will be described with reference to FIG. 9. As shown, the heat roller 1 and the heat insulating member 5 have outside diameters a and b, respectively. In this embodiment, a difference c between the outside diameters a and b is selected to be smaller than or equal to one half of a ($c=a-b\leqq a/2$). Preferably, the difference c should be smaller than or equal to one-fourth of a ($c=a-b\leqq a/4$). For experiments, the heat roller 1 was implemented by a heating base having an outside diameter of 20 mm and a thickness of 0.5 mm, and heat insulating members 5 having outside diameters of 6 mm, 10 mm and 18 mm, respectively, were prepared. Rupture tests showed that the members 5 having outside diameters of 15 mm and 18 mm clear a target safety level, that the member 5 having an outside diameter of 10 mm is difficult to clear it, and that the member 5 having an outside diameter of 6 mm cannot clear it at all. Presumably, therefore, when the difference c between the outside diameters a and b is excessively great, stresses acting on the heat roller 1 are locally increased and break the roller 1 due to their differences in contact area and deformation.

Hence, the heat roller 1 withstands mechanical heavy loads when the difference c between the outside diameters a and b is small. According to the above tests, when the difference c is less than or equal to one half of the outside diameter a, a sufficient safety level is achievable. It follows that, for a given diameter of the heating insulating element 5, the heat roller 1 should preferably have a smaller diameter in respect of resistivity to heavy loads and rapid warm-up.

6TH EMBODIMENT

Figure 10:
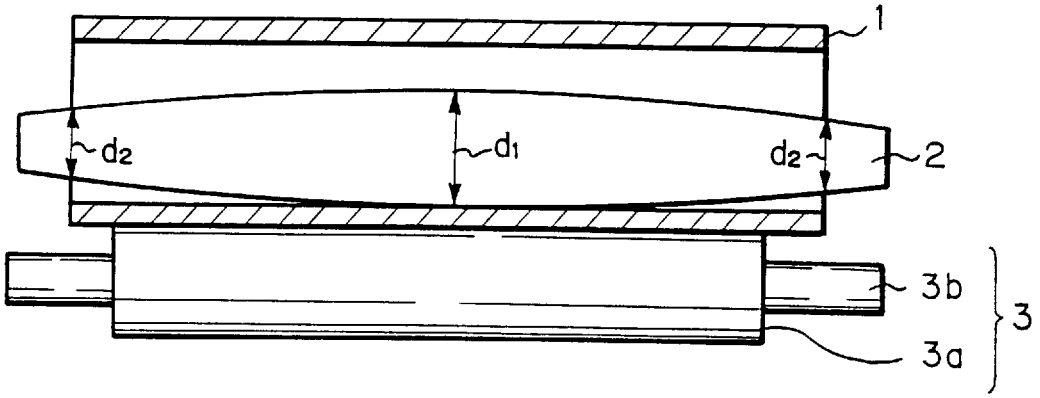
FIG. 10 is a section showing a sixth embodiment of the present invention.

FIG. 10 shows a sixth embodiment of the present invention. As shown, the pressing member 2 (or heat insulating member 5) contacting the heat roller 1 has an outside diameter $d_1$, at its intermediate portion and an outside diameter $d_2$ at its portions adjoining the opposite ends of the roller 1. The diameter $d_1$ is selected to be greater than the diameter $d_1$ ($d_1>d_2$). While the outside diameter of the pressing member 2 should preferably vary steplessly such that the member 2 resembles a barrel, this is not essential with the portions of the member 2 protruding from the heat roller 1.

In the above configuration, even when the axis of the pressing member 2 is bent, the outside diameter of the member 2, apparently, does not change. This insures the nip at the center of the pressing member 2 and thereby enhances the fixing ratio of the device. Hence, the embodiment allows a small-diameter fixing mechanism to be applied to a high-speed machine, thereby miniaturizing the equipment. This has heretofore been impracticable due to the deformation of the pressing member.

7TH EMBODIMENT

Figure 11A:
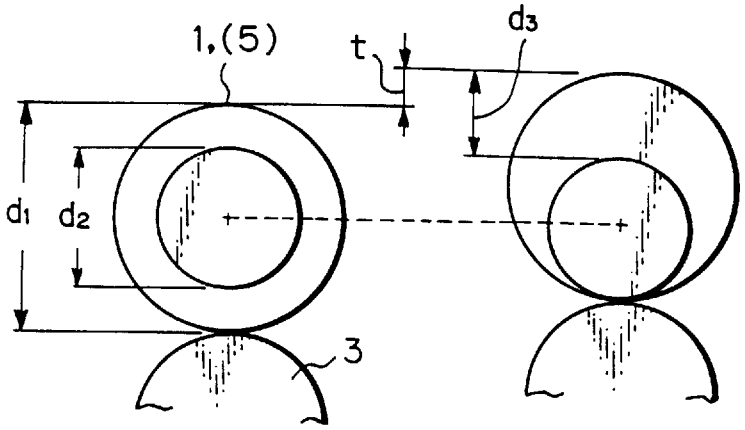
FIGS. 11A and 11B show a seventh embodiment of the present invention.
Figure 11B:
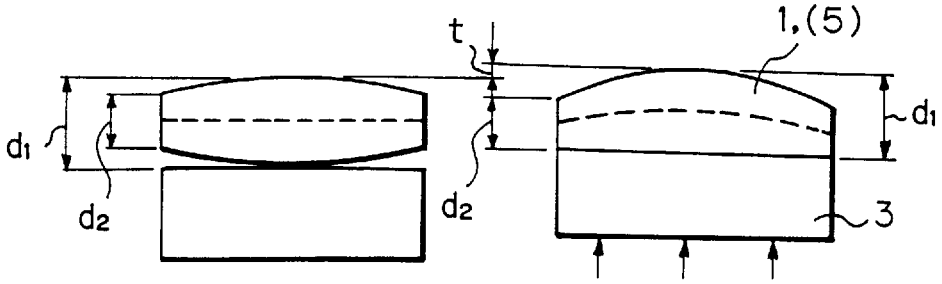

FIGS. 11A and 11B show a seventh embodiment of the present invention. As shown, the pressing member 2 (or heat insulating member 5) has a diameter $d_1$ at its intermediate portion and a diameter $d_2$ at its portions adjoining the opposite ends of the roller 1. A difference $d_3$ between the diameters $d_1$ and $d_2$ is selected to be greater than 0.05 mm ($d_1-d_2=d_3>0.05$ mm). The barrel-like pressing member 2 shown in FIG. 10 has the previously stated advantages.

However, if the diameters $d_1$ and $d_2$ of the barrel-like pressing member 2 are not determined specifically, the adequate specifications of the member 2 will not be achieved without resorting to a series of designs which increase the cost.

Specifically, when a necessary load is applied to a cylindrical pressing member 2 having a length of 300 mm and a diameter of 14 mm, a bend of about 0.1 mm occurs at the axis of the member 2. As a result, the nip width at the center of the member 2 is reduced to almost one half of the nip width at the opposite ends. When the member 20 has a diameter of 10 mm, the bend at the axis is as great as about 0.5 mm. When the member 20 has the barrel-like configuration shown in FIG. 10 and when a load is applied to the member 2 until the apparent bend of the member 2 becomes zero, as shown in FIGS. 11A and 11B, a bend t actually occurs at the axis of the member 2. However, the apparent bend (external appearance) of the member 2 is reduced due to the difference $d_3$ between the diameters $d_1$ and $d_2$, so that the adequate nip width is guaranteed even at the center of the member 2. As FIGS. 11A and 11B clearly indicate, the bend of the axis of the member 2 which can be coped with is up to one half of the difference $d_3$.

Therefore, in the illustrative embodiment, to reduce the bend t of the member 2 to below 0.05 mm which is generally considered to have no critical influence on images, t h e difference $d_3$ between the diameters $d_1$ and $d_2$ should be selected to be 0.1 mm. Bends smaller than 0.05 mm do not noticeably effect images.

As stated above, the embodiment confines the difference $d_3$ in a particular range and thereby obviates a series of costly designs.

8TH EMBODIMENT

Figure 12A:
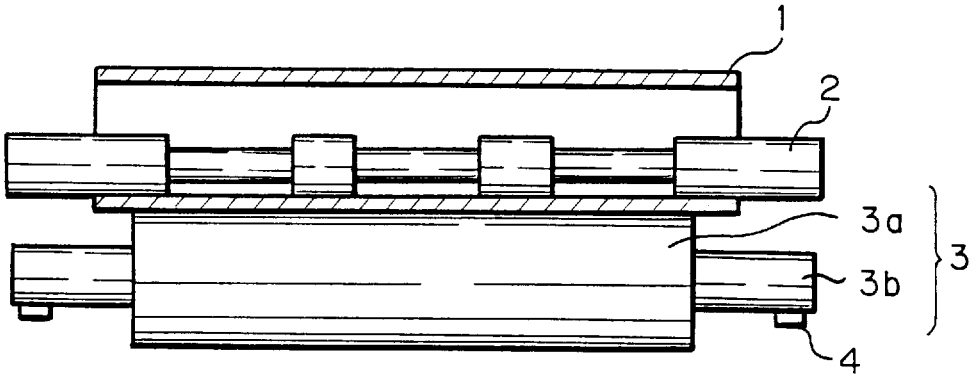
FIGS. 12A and 12B are sections showing an eighth embodiment of the present invention.
Figure 12B:
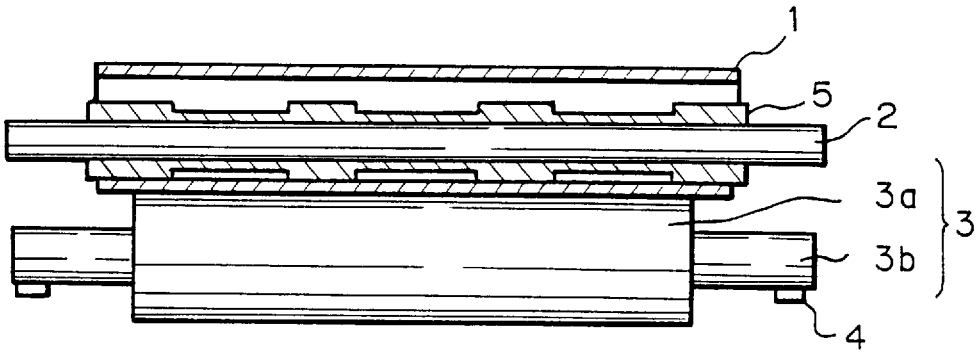

FIGS. 12A and 12B show an eighth embodiment of the present invention. As shown, the pressing member 2 or the heat insulating member 5 is so configured as to contact the heat roller 1 at a plurality of portions spaced in the axial direction. These portions contacting the heat roller 1 may be formed by locally increasing the outside diameter of the member 2 or by combining spacers or similar separate parts with the member 2. In this configuration, the area over which the member 2 or 5 contacts the heat roller 1 and, therefore, the heat transfer from the roller 1 to the member 2 is reduced. Hence, the thermal energy generated by the heating portion can be effectively used for fixation. The embodiment, therefore, heats the heat roller 1 to a desired temperature with a minimum of energy in a short period of time and thereby saves power.

9TH EMBODIMENT

Figure 13A:
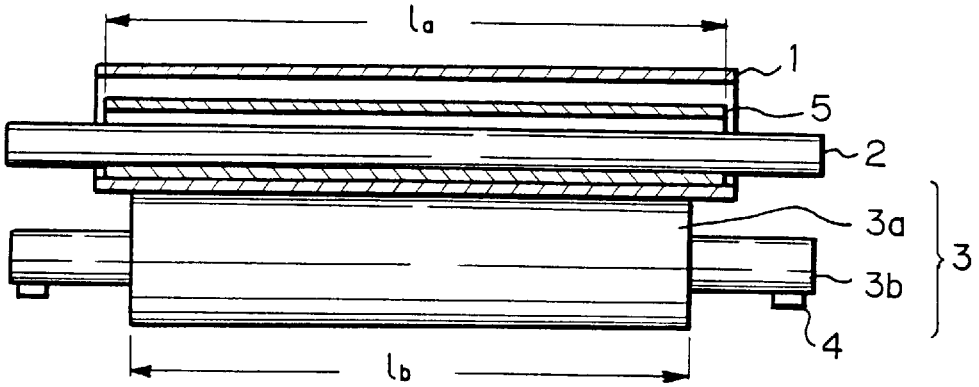
FIGS. 13A and 13B are sections showing a ninth embodiment of the present invention.
Figure 13B:
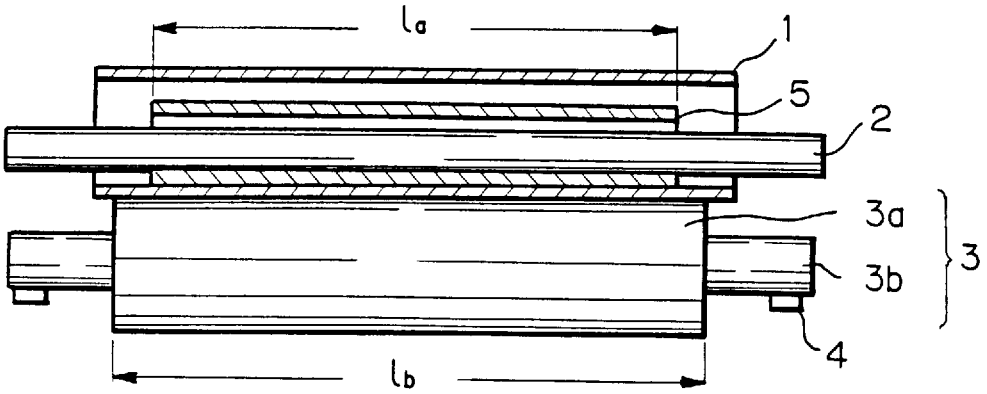

FIGS. 13A and 13B show a ninth embodiment of the present invention. As shown, the heat insulating member 5 has a length la greater than or equal to the length 1*b* of the press roller 3 (1*a*≧1*b*). Specifically, as shown in FIG. 13B, if the length 1*a* of the heat insulating member 5 is smaller than the length 1*b* of the press roller 3 (1*a*<1*b*), then a stress tending to bend the opposite ends of the roller 1 inward a c t s thereon and is apt to break the ends of the roller 1. This is because the press roller 3 is usually made of rubber or a similar soft material and exerts a load attributable to its flexibility on the opposite ends of the heat roller 1. In this condition, the press roller 3 should be prevented from exerting a heavy load on the heat roller 1. This kind of device is not adaptive to a high-speed machine which fixes images frequently.

As shown in FIG. 13A, in the embodiment, the ends of the heat insulating member 5 protrude from the ends of the press roller 3, as seen in a front view, due to the relation of 1*a*≧1*b*. Hence, the concentration of the stress on the opposite ends of the heat roller 1 and attributable to the force of the press roller 3 is obviated. This protects the opposite ends of the heat roller 1 from breakage and allows a heavier load to act on the roller 1. The embodiment is, therefore, feasible for a high-speed machine.

This embodiment is particularly advantageous when the base of the heat roller 1 is formed of glass, ceramics or a similar fragile material. Further, the embodiment reduces the deterioration of the heat roller 1 because the heating layer is free from damage attributable to the stress.

10TH EMBODIMENT

Figure 14A:
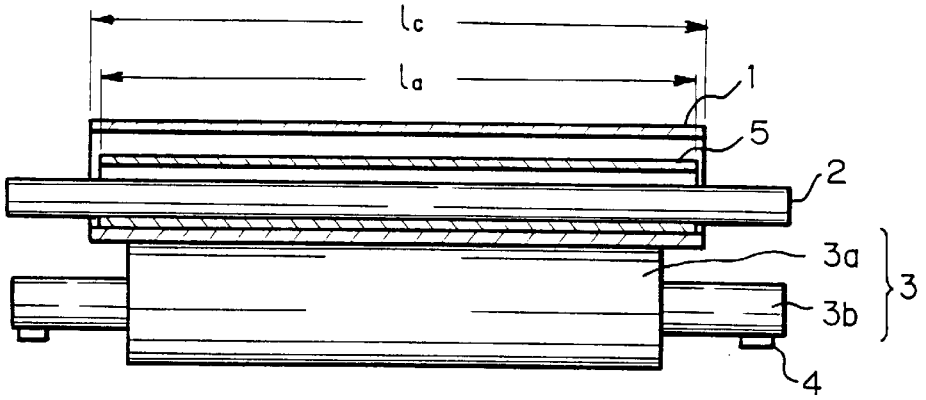
FIGS. 14A–14C are sections showing a tenth embodiment of the present invention.
Figure 14B:
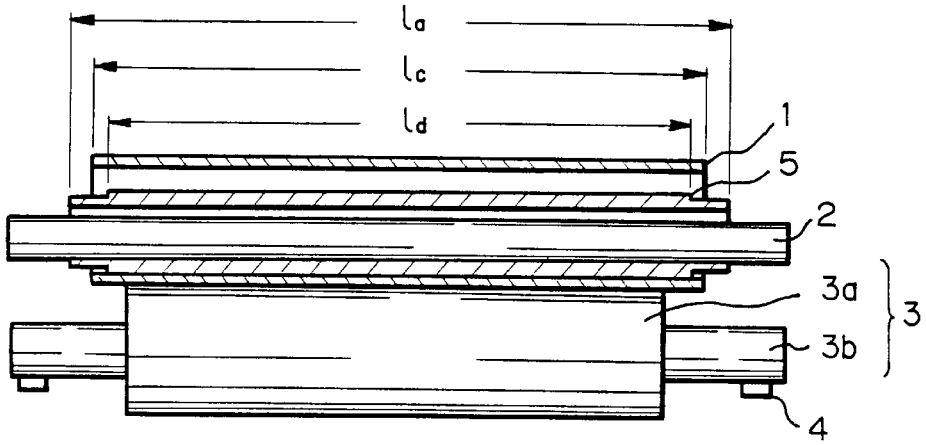
Figure 14C:
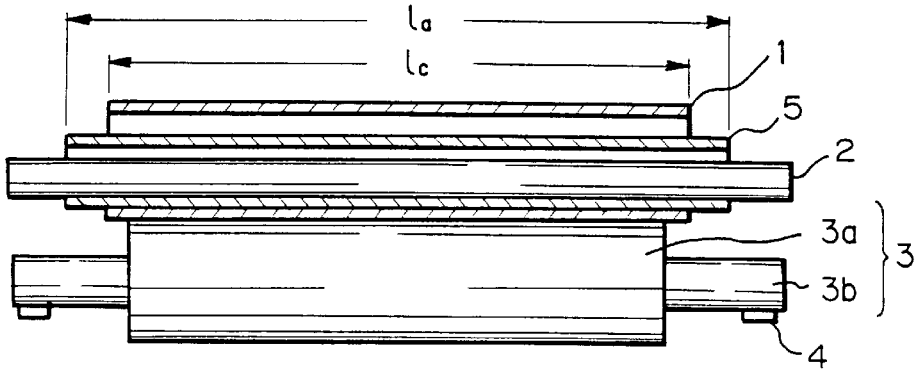

FIGS. 14A–14C show a tenth embodiment of the present invention. As shown, the length 1*a* of the heat insulating member 5 is smaller than or equal to the length 1*c* of the heat roller 1 (1*a*≦1*c*). In FIG. 14C, to set up an adequate nip width at the time of fixation, the press roller 3 applies a load matching the type of the machine to the heat roller 1 and heat insulating member 5. Hence, as shown in FIG. 14C, if the length 1*a* is greater than or equal to the length 1*c* (1*a*≧1*c*), the load exerted on the entire heat roller 1 by the press roller 3 causes the reaction of the heat insulating member 5 to act on the opposite ends of the roller 1. The reaction of the heat insulating member 5 is apt to break the heat roller 1 from the opposite ends toward the center. This again inhibits the press roller 3 from applying a heavy load on the heat roller 1 and thereby obstructs the application of the device to a high-speed machine.

As shown in FIG. 14A, in the illustrative embodiment, the length 1*a* of the heat insulating member 5 is smaller than or equal to the length 1*c* of the heat roller 1 (1*a*≦1*c*), so that the ends of the member 5 are set back from the ends of the roller 1. Alternatively, as shown in FIG. 14B, although the length 1*a* is greater than the length 1*c*, the portion of the member 5 contacting the roller 1 has a length 1*d* smaller than the length 1*c* (1*d*≦1*c*≦1*a*).

With the above dimensions, the embodiment prevents the bending stress attributable to the force of the press roller 3 from acting on the ends of the heat roller 1, thereby protecting them from breakage. This allows a heavier load to act on the heat roller 1 and promotes the application of the device to a high-speed machine. In addition, the deterioration of the heat roller 1 is reduced because the heating layer is free from damage due to the stress.

11TH EMBODIMENT

Figure 15A:
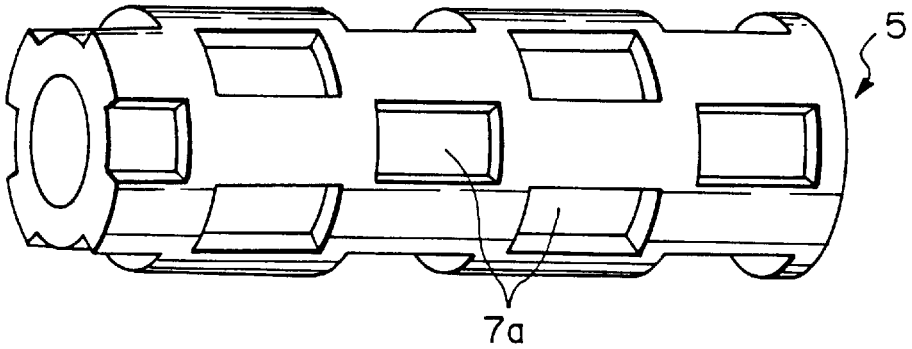
FIGS. 15A and 15B are external perspective views showing an eleventh embodiment of the present invention.
Figure 15B:
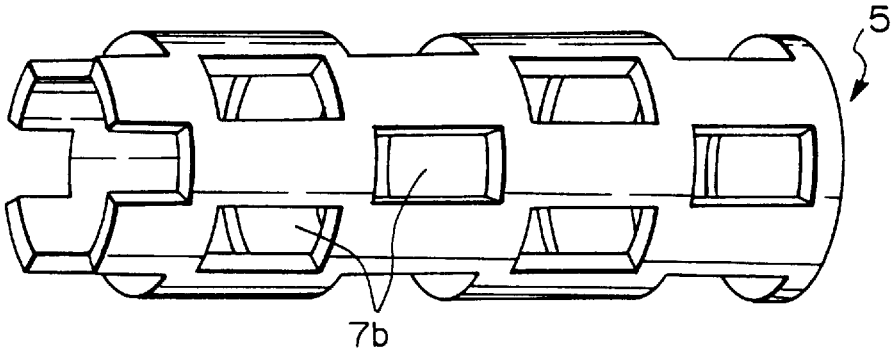

FIGS. 15A and 15B show an eleventh embodiment of the present invention. As shown, the spaces 7 (see FIG. 8) of the heat insulating member 5 are implemented as recesses 7*a* (FIG. 15A) or holes 7*b* (FIG. 15B). It is, of course, preferable that the heat generated by the heat roller 1 be entirely used to fix a toner image on a paper. In practice, however, the heat of the heat roller 1 is often lost by being transferred to the heat roller 3 made of, e.g., rubber and to the atmosphere. The heat loss obstructs the rapid temperature elevation of the heat roller 1. The heat insulating member 5 is used to obviate the excessive radiation of the heat of the heat roller 1. However, when the heat insulating member 5 contacts the heat roller 1 over its entire area, a greater amount of heat is transferred to the member 5.

In light of the above, the spaces 7 of the heat insulating member 5 are implemented as the recesses 7*a* or the holes 7*b*. The recesses 7*a* may be formed in either the outer periphery or the inner periphery of the member 5. The recesses 7*a* or the holes 7*b* reduce the volume and thermal capacity of the member 5 and, in addition, noticeably reduce the area over which the member 5 contacts the other member, i.e., the heat roller 1 or the pressing member 2.

Because the embodiment reduces the propagation of heat from the heat roller 1 to the heat insulating member 5, it is possible to heat the heat roller 1 to a desired temperature in a short period of time with a minimum of energy. In addition, because the recesses 7*a* or the holes 7*b* are easy to form, the device is low cost, warms up rapidly, and saves power.

12TH EMBODIMENT

Figure 16:
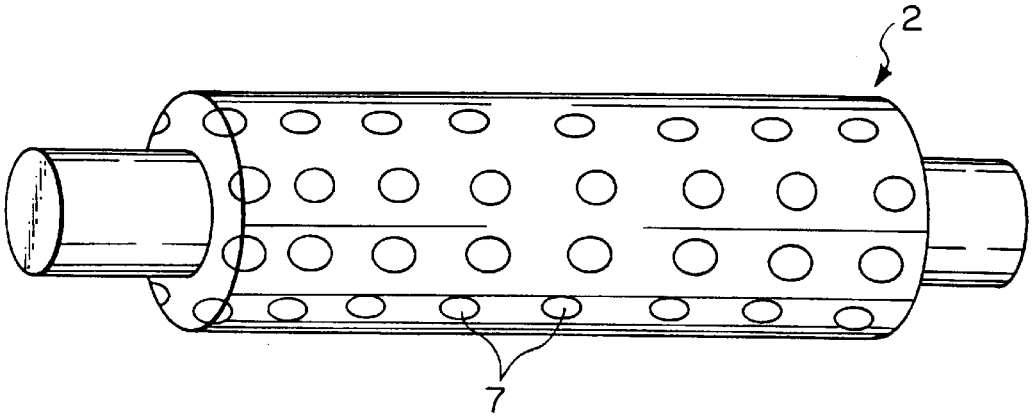
FIG. 16 is an external perspective view showing a twelfth embodiment of the present invention.

FIG. 16 shows a twelfth embodiment of the present invention. As shown, the pressing member 2 is at least partly formed with the spaces 7. The spaces 7 are formed in the inside of the pressing member 2 or on the surface of the same. When the spaces 7 are formed in the inside of the member 2, they are implemented as bubbles or tubes by way of example. When the spaces 7 are formed on the surface of the member 2, they are implemented as recesses or holes by way of example. The member 2 allows a gas lower in thermal conductivity than solids and liquids to exist in the spaces 7, so that the thermal energy to leak from the heating portion is reduced.

With the above configuration, the embodiment heats the heating member to a desired temperature with a minimum of energy and, therefore, warms up rapidly and saves power.

13TH EMBODIMENT

Figure 17:
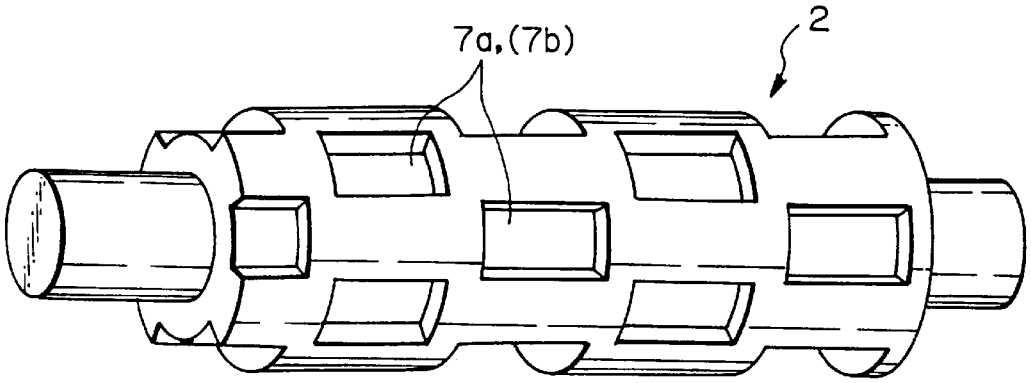
FIG. 17 is an external perspective view showing a thirteenth embodiment of the present invention.

FIG. 17 shows a thirteenth embodiment of the present invention. As shown, the pressing member 2 is formed with the spaces 7 which are implemented as the recesses 7*a* shown in FIG. 15A or the holes 7*b* shown in FIG. 15B. The heat from the heat roller 1 or the heat insulating member 5 is transferred to the pressing member 2. By reducing this heat transfer, it is possible to use the heat of the heat roller 1 for fixation more efficiently. The recesses 7*a* or the holes 7*b* reduce the volume and thermal capacity of the member 2 and, in addition, noticeably reduce the area over which the member 2 contacts the other member, i.e., the heat roller 1 or the heat insulating member 5.

Because the embodiment reduces the propagation of heat from the heat roller 1 or the heat insulating member 5 to the pressing member 2, it is possible to heat the heat roller 1 to a desired temperature in a short period of time with a minimum of energy. In addition, because the recesses 7*a* or the holes 7*b* are easy to form, the device is low cost, warms up rapidly, and saves power.

14TH EMBODIMENT

Figure 18A:
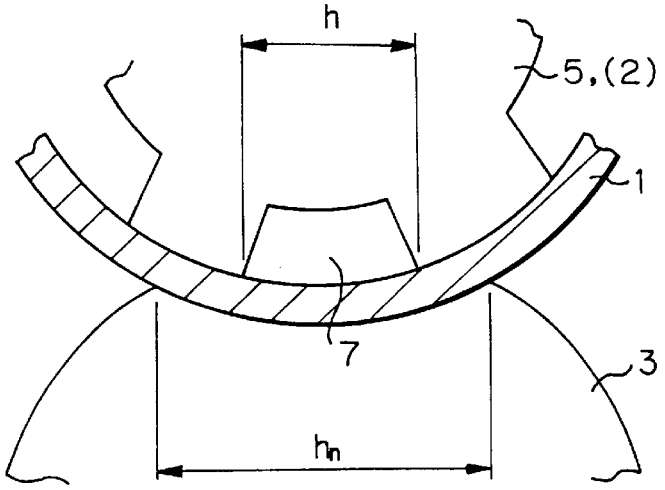
FIGS. 18A–18C are sections showing a fourteenth embodiment of the present invention.
Figure 18B:
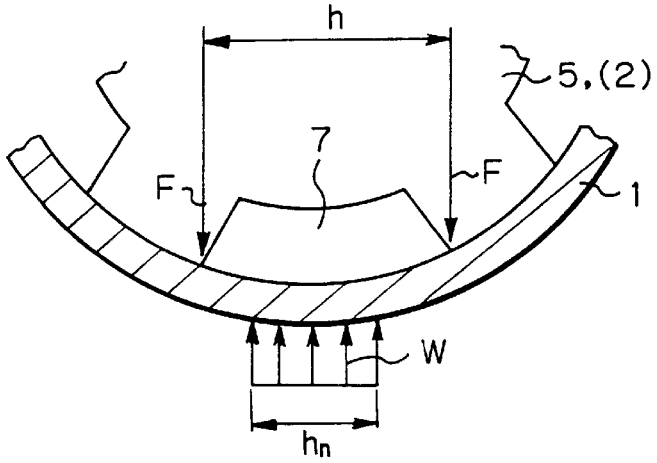

A fourteenth embodiment of the present invention will be described with reference to FIGS. 18A–18C. As shown, each space 7 formed in the heat insulating member 5 or the pressing member 2 has an open end having a width h, as measured in a section perpendicular to the axial direction of the member 5 or 2. Let the width h be referred to as the width h of the space 7 for simplicity. The width h of the space 7 is selected to be smaller than or equal to the nip width hn defined by the heat roller 1 and press roller 3 (h≦hm).

A load W to be exerted on the heat roller 1 by the press roller 3 is determined by the nip width hn between the heat roller 1 and the press roller 3, as is well known in the art. As shown in FIG. 18B, when the width h of the space 7 is greater than the nip width hn (h>hn), it is likely that a reaction F derived from the load W concentrates on the corners of the heat insulating member 5 or those of the pressing member 2. Then, only the corners of the member 5 or 2 support the entire heat roller 1. In this condition, the load W acting on the heat roller 1 is irregularly distributed and adversely effects an image.

Figure 18C:
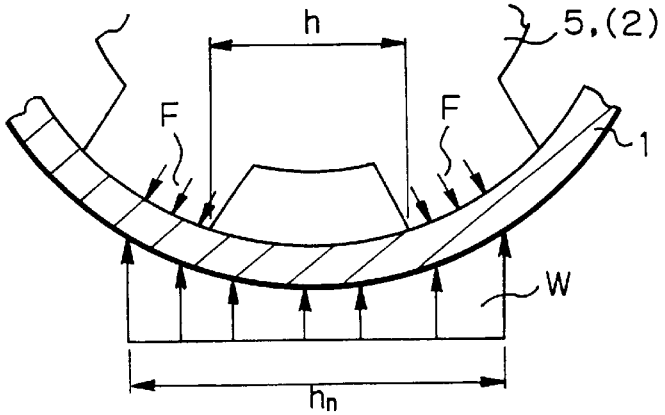

By contrast, as shown in FIG. 18C, when the width h of the space 7 is smaller than or equal to the nip width hn (h<hn), the reaction attributable to the load W acts on the surface of the heat insulating member 5 or that of the pressing member 2. Hence, the surface of the member 5 or 2 supports the heat roller 1. Consequently, the load W acting on the heat roller 1 is relatively uniformly distributed and does not adversely effect an image. That is, the stress is prevented from concentrating on a part of the heat roller, so that a heavier load W can be applied to the heat roller 1.

With the above advantage, the illustrative embodiment is applicable to a high-speed machine which exerts a heavier load. Because the concentration of the stress on the heat roller 1 is reduced, a thinner heating base is usable and provides the device with a small thermal capacity and a rapid warm-up capability.

15TH EMBODIMENT

Figure 19A:
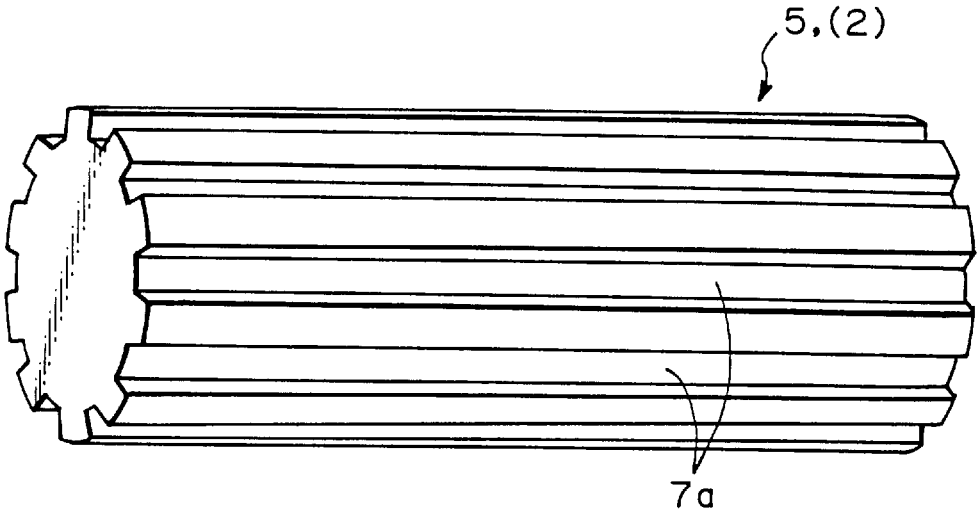
FIGS. 19A and 19B are external perspective views showing a fifteenth embodiment of the present invention.
Figure 19B:
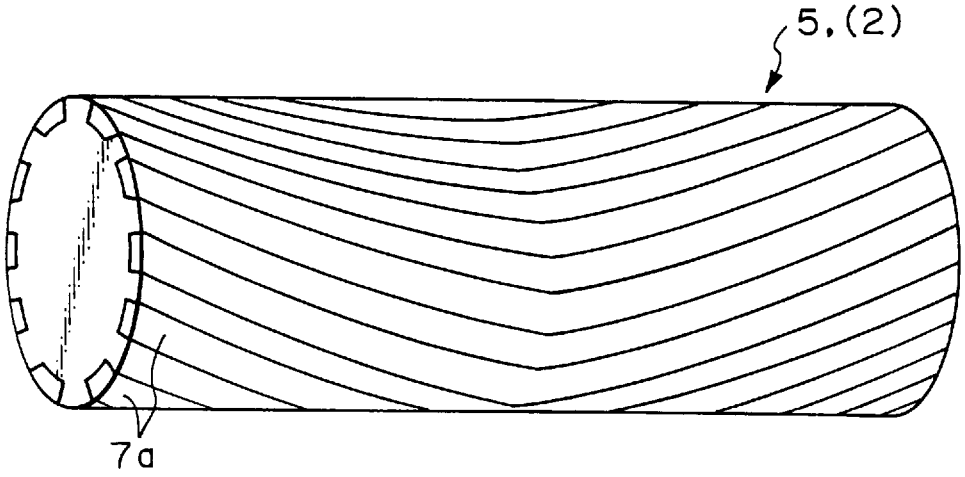

FIGS. 19A and 19B show a fifteenth embodiment of the present invention. As shown, the heat insulating member 5 or the pressing member 2 has the spaces 7 implemented as the recesses 7*a*. The recesses 7*a* are constituted by elongate grooves extending in the axial direction of the member 5 or 2, as shown in FIG. 19A, or inclined relative to the axial direction, as shown in FIG. 19B. Further, the center line of each groove or recess 7*a* may be straight or curved. The recesses 7*a* may be replaced with the previously stated holes 7*b*, if desired.

The embodiment allows the heat insulating member 5 or the pressing member 2 with a smaller contact area with the other member to be formed more easily and, therefore, reaches a desired temperature and warms up more rapidly.

16TH EMBODIMENT

Figure 20A:
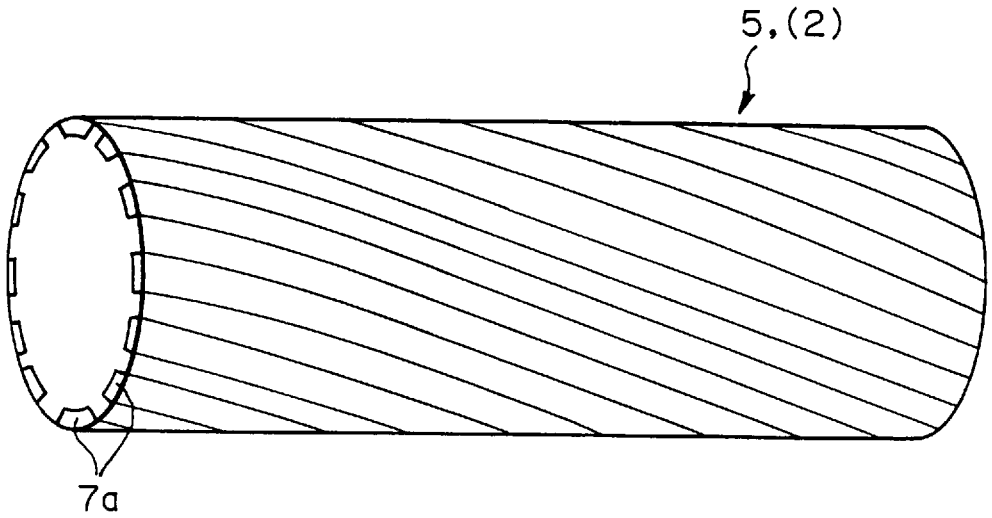
FIGS. 20A and 20B are external perspective view showing a sixteenth embodiment of the present invention.
Figure 20B:
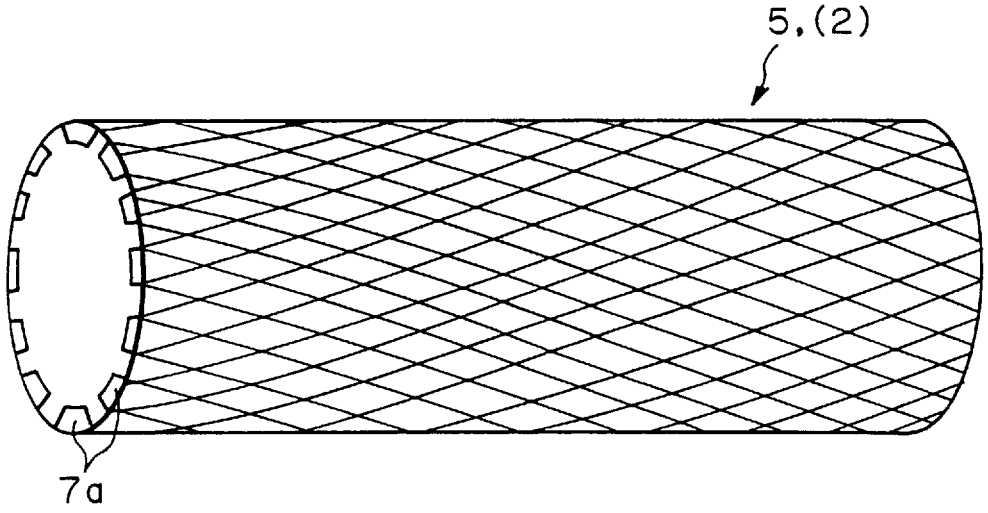

FIGS. 20A and 20B show a sixteenth embodiment of the present invention. As shown, the heat insulating member 5 or the pressing member 2 is formed with the recesses 7*a* whose center lines extend spirally. When the center lines of the recesses 7*a* of the member 5 or 2 extend linearly in the axial direction, as stated with reference to FIG. 19A, the member contacting the member 5 or 2 (heat roller 1) contacts the member 5 or 2 intermittently while the member 5 or 2 is in rotation. This is apt to generate vibration and noise and lower the durability of the device.

In accordance with the embodiment, the center lines of the recesses 7*a* extend spirally like a screw, as shown in FIG. 20A. Preferably, the recesses 7*a* should preferably be configured such that a plurality of threads exist for a single lead, as is the case with a multiple thread. As shown in FIG. 20B, the recesses 7*a* may be formed in a crosshatch pattern by knurling, if desired. With this configuration, a part of the surface of the member 5 or 2 surely remains in a line-to-line contact with the heat roller 1 at all times.

As stated above, when the member 5 or 2 is rotated, the member contacting the member 5 or 2 (heat roller 1) continuously contacts the surface of the member 5 or 2. This noticeably reduces vibration and noise and thereby enhances the durability of the device, protects images from deterioration, contributes to cost reduction, and enhances reliability.

17TH EMBODIMENT

FIG. 21 shows a seventeenth embodiment of the present invention. As shown, each recess 7*a* of the heat insulating member 5 or the pressing member 2 has a center line O whose maximum rotation angle θmax is greater than or equal to the angle θ of the width of the recess 7*a* (θ≦θmax). Specifically, the center line O extends in the axial direction of the member 5 or 2 while sequentially moving in the circumferential direction of the same. Hence, when the maximum rotation angle θmax of the center line O in the circumferential direction is greater than or equal to the angle θ, the maximum radius of the member 5 or 2, as measured on any line on the outer periphery parallel to the axis of the member 5 or 2 and containing the recess 7*a*, is coincident with the radius of the outer periphery of the member 5 or 2. That is, a part of the outer periphery of the member 5 or 2 surely contacts the heat roller 1 at all times.

As stated above, because the maximum rotation angle θmax is greater than or equal to the angle θ, when the member 5 or 2 is rotated, the member contacting it (heat roller 1) can continuously contact the surface of the member 5 or 2. As a result, vibration and noise attributable to the rotation is reduced, so that the durability of the device is enhanced. At the same time, the device protects images from deterioration, reduces the cost, and enhances reliability.

18TH EMBODIMENT

Referring to FIG. 22, an eighteenth embodiment of the present invention will be described. As shown, a heat roller 10 is implemented as a glass pipe structure 10A having a wall thickness t of 0.3 mm and formed of borosilicate glass, e.g., Pyrex (trade name). A heating element 12 and a protection layer 14 are sequentially formed on the structure 10A. The heating element 12 is connected to electrodes 16 extending on the surface of the structure 10A. To form the heating element 12, Au-based resinate paste is printed on the surface of the heat roller 10, then dried, and then sintered. For the protection layer 14, use is made of Teflon (trade name). Specifically, the heating element 12 is produced by mixing Pd, PT, Bi, Rh, Sn or a similar component with Au which is a major and conductive component. Au may be replaced with Ru (ruthenium), if desired.

The warm-up time from the room temperature to 180° C. and available with the device including the heat roller 10 was measured. When the power density (W) was 3 W/cm$^2$, as shown in Table 1 below, the warm-up time was about 25 seconds. When the power density (W) was 6 W/cm$^2$, the warm-up time was about 11 seconds. For the measurement, the glass pipe structure 10A was provided with an outside diameter of 20 mm, a length of 315 mm, and a thickness of 1.5 mm.

TABLE 1

| Power Density | Heating Element Au-Based Resinate Paste |
|---|---|
| 3 W/cm$^2$ | No defects occurred after 30,000 cycles. |
| 6 W/cm$^2$ | Visible separation and increase in resistance by 30% to 50% occured after less than 10,000 cycles. |

Generally, Au or a similar metallic resinate paste has a far higher thermal expansivity than glass. For example, while the previously mentioned borosilicate glass has a thermal expansivity of $30\times10^{-7}$/°C. to $50\times10^{-7}$/°C., the Au-based resinate paste has a thermal expansivity of $80\times10^{-7}$/°C. to $200\times10^{7}$/°C. This clearly indicates that the heating element is more flexible when subjected to heat.

In the illustrative embodiment, the considerable difference in thermal expansion between the glass pipe structure 10A and the heating element 12 is reduced by adequately selecting the thickness of the structure 10A. Hence, the heating element is prevented from coming off the surface of the structure 10A. In addition, the structure 10A is prevented from producing a condition which would delay the temperature elevation of the heating element and electrodes. This eliminates cracking and separation which are likely to occur between the heating element and the electrodes.

Table 2 shown below lists a relation between the power density (W) and the thickness (t) in terms of warm-up time by using durability as a criterion. The word "durability" refers to the fact that the separation of the heating element 12 from the structure 10A and the separation and cracking between the heating layer and the electrodes do not occur.

TABLE 2

| Power Density | Thickness (mm) of Structure | | | | |
|---|---|---|---|---|---|
| (W/cm$^2$) | 1.5 | 1.0 | 0.7 | 0.5 | 0.3 |
| 8 | | Δ 5 sec | 4 sec | Δ 3.5 sec | ○ 2.5~3.5 sec |
| 6 | x 11 sec | Δ 6.5 sec | ○ 5.sec | ○ 4 sec | ○ 3.5 sec |
| 4 | | ○ 10 sec | ○ 8 sec | 6.5 sec | 5 sec |
| 3 | ○ 2.5 sec | 13.5 sec | 10.5 sec | 8.5 sec | 6 sec |
| 2 | no data | 19 sec | 15 sec | 12 sec | 8.5 sec |

Figure 23:
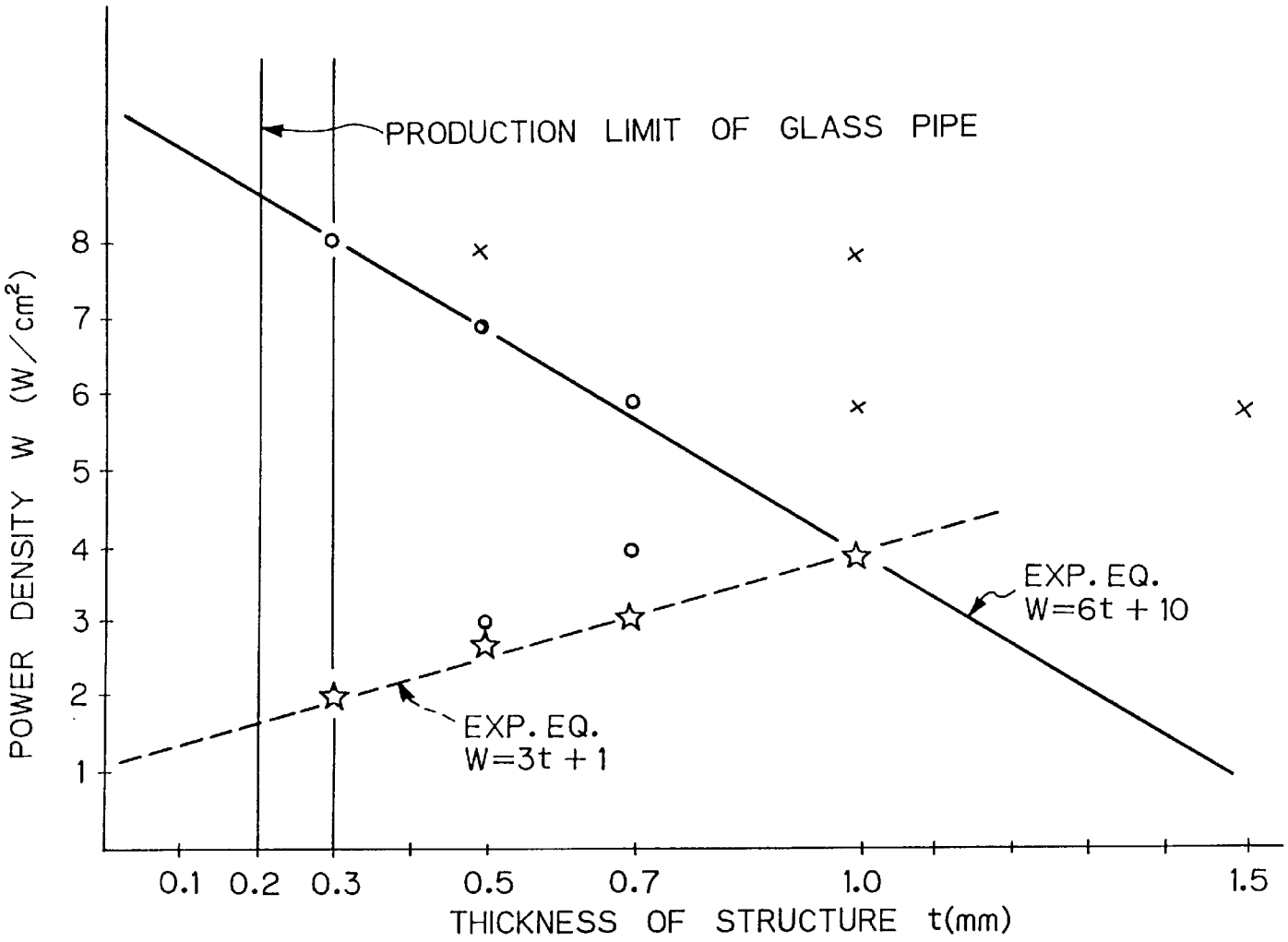
FIG. 23 is a graph representative of durability and warm-up time derived from a relation between the power density and the thickness of a heat roller included in the eighteenth embodiment.

○: No defects after 30,000 cycles
Δ: Resistance increased
x: Separation or cracking occurred
/: No durability data FIG. 23 plots the above results "○", "Δ" and "x" of Table 2; the ordinate and the abscissa are respectively representative of the power density (W) and the wall thickness (t) of the structure 10A. In FIG. 23, the asterisks show points where the warm-up time is 10 seconds for a reference. As Table 2 and FIG. 23 indicate, in a condition wherein the warm-up time is as short as about 10 seconds, the thickness (t) of the structure 10A capable of obviating the defects between the heat roller 10, heating element 12 and electrodes 14 is less than 1 mm, but preferably more than 0.2 mm. By changing the power density in matching relation to the thickness (t), it is possible to maintain the above warm-up time even after a heating cycle has been repeated 30,000 times.

The above experiments show that in order to maintain the durability and warm-up characteristic, it is important that the characteristic of the glass pipe structure 10A, particularly the relation between the power density (W) and the thickness (t), satisfies the following relations at the same time:

$$W=-6t+10 \quad (1)$$

$$W=3t+1 \quad (2)$$

$$t\geqq0.2 \quad (3)$$

The above relation (3) assumes the limit of a glass pipe in the production aspect, and this value can, of course, be used. It follows that such a specific value may be changed if a smaller wall thickness is available in practice.

As stated above, only if the heat roller 10 implemented by the glass pipe structure 10A satisfies the relations (1)–(3) at the same time, not only the warm-up time is reduced, but also the desirable thermodynamic characteristic of the heat roller is maintained.

Regarding the warm-up time, assume that a printer, for example, starts raising the temperature of its fixing device to a preselected temperature at the same time as it starts receiving data. Then, the fixing device should only be warmed up to the preselected temperature before one page of bit map data is completed. In practice, however, 10 seconds to 20 seconds are necessary for one page of bit map image to be completed. Hence, the warm-up time of less than 10 seconds to 15 seconds suffices. This is why the warm-up time is assumed to be 10 seconds in the above description.

Figure 24:
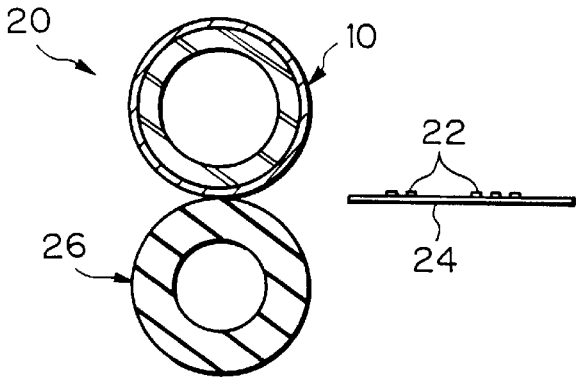
FIG. 24 shows the construction of the eighteenth embodiment specifically.

Generally, a fixing device having the heat roller 10 is constructed as shown in FIG. 24. As shown, the fixing device, generally 20, has the heat roller 10, and a press roller 26 facing the heat roller 10 with the intermediary of a path along which a paper 24 carrying a toner 22 thereon is conveyed. The press roller 26 is made of rubber and is rotatable for conveying the paper 24 while pressing it against the heat roller 10. As a result, the toner on the paper 24 is melted and fixed by pressure and heat.

Figure 25:
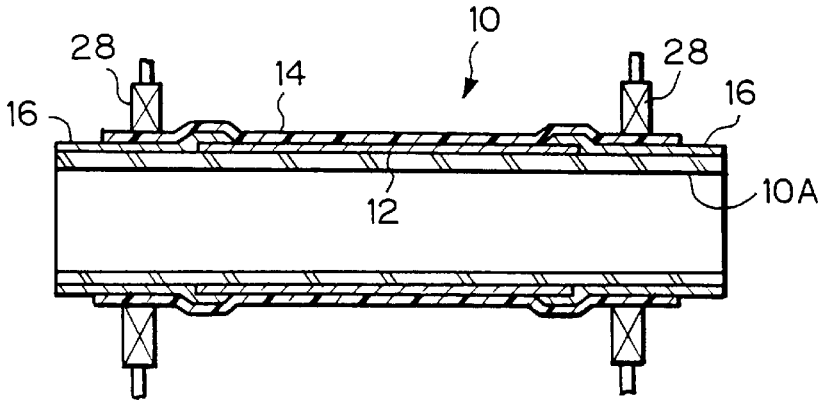
FIG. 25 shows a structure for supporting a heat roller and included in the construction of FIG. 24.

The pressure exerted by the press roller 26 sometimes causes the heat roller 10 to deform or bend. Specifically, as shown in FIG. 25, the heat roller 10 is rotatably supported by bearings 28 at opposite ends thereof. However, the intermediate portion of the heat roller 10 not supported by the bearings 28 is apt to noticeably bend due to the force of the press roller 26. As a result, the nip width between the two rollers 10 and 26 decreases at the intermediate portion and increases in the end portions. Because the fixing ability of the device is effected by the nip width, the bend of the heat roller 10 lowers the fixing ratio at the intermediate portion. While the fixing speed may be increased in order to enhance efficient fixation, it is impossible to increase the fixing speed while maintaining a preselected fixing ratio, unless a great nip width is set up.

Borosilicate glass constituting the glass pipe structure 10A has a Young's modulus of about 6,000 kg/cm$^2$ to 7,000 kg/cm$^2$ which is comparable with or even greater than that of aluminum. This provides the structure 10A, i.e., the heat roller 10 with durability against bending.

Assume that the pressure of the press roller 26 is further increased in order to further increase the fixing speed, i.e., fixing efficiency. Then, the bend at the intermediate portion of the heat roller 10 simply increases without the nip width being noticeably increased; rather, the nip width sometimes decreases due to the increase in bend. A specific arrangement for guaranteeing the desirable nip width will be described with reference to FIG. 26.

Figure 26:
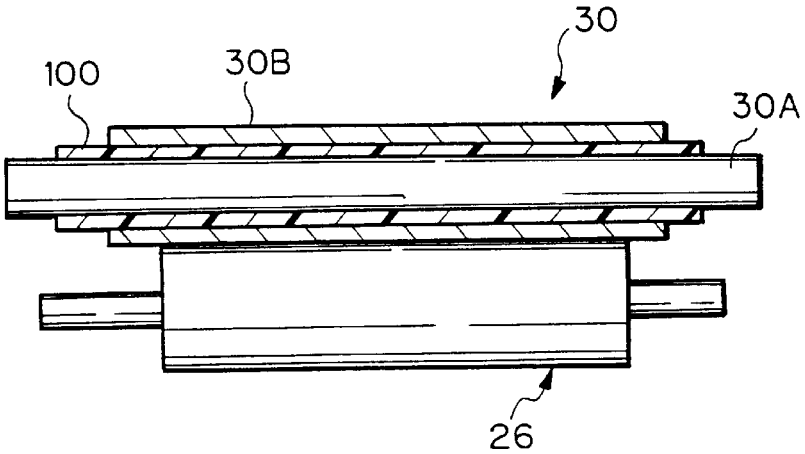
FIG. 26 is a section showing the internal arrangement of the heat roller included in the construction of FIG. 24.

As shown in FIG. 26, a heat roller 30 has a shaft portion 30A made of stainless steel. A support member 100 is mounted on the outer periphery of the shaft portion 30A. Further, a heating layer 30B including a glass pipe structure, heating element and electrodes is mounted on the outer periphery of the support member 100. The support member 100 is a hollow member constructed integrally with the shaft portion 30A and formed of phenol resin whose thermal conductivity is lower than that of the glass pipe structure.

In the above construction, the bend of the heat roller 30 in the axial direction is reduced by the rigidity of the shaft portion 30A. In addition, because the support member 100, intervening between the heating layer 30B and the shaft portion or good thermal conductor 30A, plays the role of a heat insulating member, the heat transfer from the heating layer 30B is intercepted. Hence, when the heating layer 30B generates heat, the heat is prevented from being transferred to the shaft portion 30A. This successfully prevents the temperature elevation characteristic of the heat roller 30 from being deteriorated.

In summary, it will be seen that the present invention provides a fixing device for an image forming apparatus and having various unprecedented advantages, as enumerated below.

(1) A heat roller is free from deformation despite that it has a hollow base. Hence, for a heating body, use can be made of a heat roller having a small thermal capacity. This reduces the heat elevation time of the heat roller and thereby realizes a heating device which eliminates the need for preheating in a stand-by mode. As a result, the total power consumption of the device is noticeably reduced.

(2) To reduce the deformation of the heat roller, it has been customary to provide the roller with a great outside diameter and thereby increase the sectional secondary moment. By contrast, the invention reduces the outside diameter of the roller for a given degree of deformation. In addition, because a pressing member for avoiding the deformation of the roller is disposed in the roller, the overall construction is miniature, compared to the case in which the pressing member is located outside of the roller. Hence, the device has mechanical strength great enough to withstand a high contact pressure necessary for a high-speed machine.

(3) The pressing member is configured as a freely rotatable roller. This reduces friction acting between the pressing member and the heat roller. As a result, the wear of the heat roller 1 and pressing member is reduced to extend the life of the device.

(4) Metal powder attributable to the wear of the heat roller and pressing member 2 is prevented from noticeably disturbing a toner image.

(5) Because the friction between the heat roller and the pressing member is reduced, the torque necessary for the drive of the heat roller is reduced. As a result, a mechanism for driving the roller is reduced in size, weight, and power consumption.

(6) Because a preselected temperature is achievable with a minimum of thermal energy, the device warms up in a short period of time and consumes a minimum of power.

(7) A heat insulating member having a heat insulating layer is interposed between the heat roller and the pressing member. The heat insulating member obstructs the transfer of heat from the heating body to the pressing member, so that the thermal energy generated by the heating body is effectively used. Hence, the embodiment further reduces the consumption of thermal energy, promotes the rapid temperature elevation of the heating body, and thereby saves power.

(8) The heat insulating member is implemented as a freely rotatable hollow cylindrical body. Hence, the heat insulating member and the heat roller contacting it wear little and extend the life of the product, thereby reducing the cost of the product. The decrease in the friction between the roller and the member allows the roller to be driven by a minimum of torque. This miniaturizes the drive mechanism and thereby miniaturizes the overall device while saving power.

(9) The hollow heat insulating member is rigid and, therefore, easy to rotate, simple in configuration, and of low cost. In addition, because this member is simple and rotates smoothly, a toner image is free from deterioration attributable to the vibration of the member.

(10) The heat insulating member and pressing member are constructed integrally with each other. Hence, for a given inside diameter of the heat roller, the pressing member can be provided with a greater diameter. The device is, therefore, feasible for a high-speed machine exerting a higher pressure.

(11) When the outside diameter of the pressing member is relatively small, the heat roller can be provided with a smaller diameter relative to the heat insulating member. The device, therefore, has a small thermal capacity and warms up more rapidly.

(12) Spaces formed in the heat insulating member allow a gas lower in thermal conductivity than solids and liquids to exist therein, thereby reducing the thermal energy to leak from the heating portion. In addition, this further reduces the energy necessary for the heating body to reach a preselected temperature, thereby enhancing the rapid start-up of the device and reducing power consumption.

(13) The difference between the outside diameter of the heat roller and that of the heat insulating member is selected to be smaller than or equal to one half of the heat roller in order to guarantee a sufficient safety level. Hence, for a given diameter of the heat insulating member, the heat roller can be provided with a smaller diameter. The device is, therefore, free from damage due to loads and warms up more rapidly.

(14) The diameter of the pressing member is selected to be greater at the intermediate portion than at the portions adjoining ends of the heat roller. In this configuration, even when the axis of the pressing member is bent, the outside diameter of the member, apparently, does not change. This insures the nip at the center of the pressing member and thereby enhances the fixing ratio of the device. Hence, a small-diameter fixing mechanism is allowed to be applied to a high-speed machine, thereby miniaturizing the equipment. This has heretofore been impracticable due to the deformation of the pressing member.

(15) The difference in outside diameter is confined in the particular range and obviates a series of costly designs.

(16) The area over which the pressing member or the heat insulating member contacts the heat roller and, therefore, the heat transfer from the heat roller to the pressing member is reduced. Hence, the thermal energy generated by the heating portion can be effectively used for fixation. Therefore, the heat roller 1 is heated to a desired temperature with a minimum of energy in a short period of time and thereby saves power.

(17) The heat insulating member is longer than the press roller. Hence, the concentration of the stress on the opposite ends of the heat roller and attributable to the force of the press roller is obviated. This protects the opposite ends of the heat roller from breakage and allows a heavier load to act on the heat roller. The device is, therefore, feasible for a high-speed machine. Further, the invention reduces the deterioration of the heat roller because the heating layer is free from damage attributable to the stress.

(18) Because the bending stress attributable to the force of the press roller is prevented from acting on the ends of the heat roller, they are protected from breakage. This allows a heavier load to act on the heat roller and promotes the application of the device to a high-speed machine. In addition, the deterioration of the heat roller is reduced because the heating layer is free from damage due to the stress.

(19) Recesses or holes formed in the heat insulating member reduce the volume and thermal capacity of the member and, in addition, noticeably reduce the area over which the member contacts the other member. Because the propagation of heat from the heat roller to the heat insulating member is reduced, it is possible to heat the heat roller 1 to a desired temperature in a short period of time with a minimum of energy. In addition, because the recesses or the holes are easy to form, the device is low cost, warms up rapidly, and saves power.

(20) The pressing member allows a gas lower in thermal conductivity than solids and liquids to exist in its spaces, so that the thermal energy to leak from the heating portion is reduced. The heating member is heated to a desired temperature by a minimum of energy and, therefore, warms up rapidly and saves power.

(21) The recesses or the holes of the pressing member reduce the volume and thermal capacity of the member and, in addition, noticeably reduce the area over which the member contacts the other member. Because this reduces the propagation of heat from the heat roller or the heat insulating member to the pressing member, it is possible to heat the heat roller to a desired temperature in a short period of time with a minimum of energy. In addition, because the recesses or the holes are easy to form, the device is low cost, starts up rapidly, and saves power.

(22) The width of each space of the heat insulating member or the pressing member is smaller than or equal to the nip width between the heat roller and the press roller. The surface of the heat insulating member or that of the pressing member supports the heat roller. Consequently, the load acting on the heat roller is relatively uniformly distributed and does not adversely effect an image. That is, the stress is prevented from concentrating on a part of the heat roller, so that a heavier load can be applied to the heat roller 1. With this advantage, the device is applicable to a high-speed machine which exerts a heavier load. Because the concentration of the stress on the heat roller is reduced, a thinner heating base is usable and provides the device with a small thermal capacity and a rapid start-up capability.

(23) The heat insulating member or the pressing member with a smaller contact area with the other member can be formed more easily and, therefore, so that the device reaches a desired temperature and warms up more rapidly.

(24) When the heat insulating member or the pressing member is rotated, the member contacting it continuously contacts the surface of the member of the latter. This noticeably reduces vibration and noise and thereby enhances the durability of the device, protects images from deterioration, contributes to cost reduction, and enhances reliability.

(25) The maximum rotation angle of the center lines of the recesses, as measured in the circumferential direction, is greater than or equal to the angle of the width of the recesses. When the heat insulating member or the pressing member is rotated, the member contacting it can continuously contact the surface of the latter. As a result, vibration and noise attributable to the rotation is reduced, so that the durability of the device is enhanced. At the same time, the device protects images from deterioration, reduces the cost, and enhances reliability.

(26) The temperature difference between the front and the rear of a glass pipe structure is reduced by taking account of the wall thickness of the structure, so that the thermal expansion of the structure is free from obstruction. In addition, the structure with a thin wall well follows the temperature variation of the heating layer, thereby enhancing the warm-up characteristic of the heat roller.

(27) Support members are disposed in the hollow of the glass pipe structure and play the role of reinforcing members. This reduces the bending of the side of the structure adjoining the heat roller due to the force of the press roller.

Various modifications will become possible for those skilled in the art after receiving the teachings of the present disclosure without departing from the scope thereof. For example, while the heating element has been shown and described as being arranged on the surface of the glass pipe structure, it may be buried in the structure.

What is claimed is:

1. A thermal fixing device comprising:

a hollow heat generating member comprising at least a heat generating layer;

a first pressing member disposed in said heat generating member throughout said heat generating member and rotating independently of said heat generating member;

a second pressing member located outside of said heat generating member; and biasing means for biasing at least one of said first and second pressing members toward the other to thereby urge said heat generating member against said first pressing member or said second pressing member, wherein said first pressing member comprises a freely rotatable roller.

2. A device as claimed in claim 1, wherein said roller has a hollow cylindrical configuration.

3. A device as claimed in claim 1, further comprising a heat insulating member interposed between said first pressing member and said heat generating member, and comprising a heat insulating layer lower in thermal conductivity than said first pressing member.

4. A device as claimed in claim 3, wherein said heat insulating member has a hollow cylindrical configuration, said first pressing member being disposed in said heat insulating member.

5. A device as claimed in claim 4, wherein said heat insulating member is rigid.

6. A device as claimed in claim 5, wherein said heat insulating member and said first pressing member are constructed integrally with each other.

7. A device as claimed in claim 3, wherein said heat insulating member is formed with one of recesses and holes in at least a part thereof.

8. A device as claimed in claim 7, wherein said recesses extend linearly.

9. A device as claimed in claim 7, wherein center lines of said recesses extend spirally.

10. A device as claimed in claim 8, wherein each of the center lines of said recesses has a maximum rotation angle, as measured in a circumferential direction of said heat insulating member, greater than or equal to a width of the recess.

11. A device as claimed in claim 10, wherein an open end of each of one of said recesses and holes has a width, as measured in a section perpendicular to an axial direction of said heat insulating member, smaller than or equal to a nip width defined between said heat generating member and said second pressing member.

12. A device as claimed in claim 3, wherein one of said first pressing member and said heat insulating member contacting said heat generating member has, at an intermediate portion, an outside diameter greater than an outside diameter of said first pressing member or said heat insulating member as measured at end portions of said heat generating member.

13. A device as claimed in claim 12, wherein a difference between a diameter of said intermediate portion of said first pressing member or said heat insulating member and a diameter of said first pressing member or said heat insulating member as measured at said end portions of said heat generating member is greater than 0.05 mm.

14. A device as claimed in claim 3, wherein one of said first pressing member and said heat insulating member directly contacting said heat generating member contacts said heat generating member at a plurality of portions spaced in an axial direction thereof.

15. A device as claimed in claim 3, wherein said heat insulating member has a length greater than or equal to a length of said pressing member.

16. A device as claimed in claim 15, wherein the length of said heat insulating member is smaller than or equal to a length of said heat generating member.

17. A device as claimed in claim 1, wherein at least one of said first and second pressing members comprise one of recesses or holes.

18. A device as claimed in claim 17, wherein said recesses extend linearly.

19. A device as claimed in claim 17, wherein center lines of said recesses extend spirally.

20. A device as claimed in claim 18, wherein center lines of said recesses each has a maximum rotation angle, as measured in a circumferential direction of said pressing member, greater than or equal to an angle of the recess.

21. A device as claimed in claim 17, wherein an open end of each of said spaces has a width, as measured in a section perpendicular to an axial direction of said pressing member, smaller than or equal to a nip width defined between said heat generating member and said second pressing member.

22. In a thermal fixing device comprising a heat roller made up of a glass pipe structure, a heat generating member formed on a surface of said glass pipe structure and comprising a heating element, and a protection layer for protecting said heat generating member, said heat roller satisfies the following relations at the same time:

$$W \leqq 6t+10 \quad (1)$$

$$W \geqq 3t+1 \quad (2)$$

$$t \geqq 0.2 \quad (3)$$

where t (mm) is a wall thickness of said glass pipe structure, and W ($W/cm^2$) is a power density to be applied to said heat generating member.

23. In a thermal fixing device comprising a heat roller made up of a glass pipe structure, a heat generating member formed on a surface of said glass pipe structure and comprising a heating element, and a protection layer for protecting said heat generating member, said heat roller satisfies the following relations at the same time:

$$W \leqq -6t+10 \quad (1)$$

$$W \geqq 3t+1 \quad (2)$$

$$t \geqq 0.2 \quad (3)$$

where t (mm) is a wall thickness of said glass pipe structure, and W ($W/cm^2$) is a power density to be applied to said heat generating member;

wherein said heat roller further comprises:

a support member disposed in a hollow of said glass pipe structure and having a greater Young's modulus than said glass pipe structure; and a heat insulating member interposed between said glass structure and said support member, and having a smaller thermal conductivity than said glass pipe structure.

24. A thermal fixing device comprising:

a hollow heat generating member comprising at least a heat-generating layer;

a first pressing member disposed in said heat generating member;

a second pressing member located outside of said heat generating member; and biasing means for biasing at least one of said first and second pressing members toward the other to thereby urge said heat generating member against said first pressing member or said second pressing member;

wherein at least one of said first and second pressing members is formed with recesses in at least a part thereof; and wherein center lines of said recesses extend spirally.

25. A device as claimed in claim 24, wherein said first pressing member comprises a freely rotatable roller.

26. A device as claimed in claim 25, wherein said roller has a hollow cylindrical configuration.

27. A thermal fixing device comprising:

a hollow heat generating member comprising at least a heat-generating layer;

a first pressing member disposed in said heat generating member;

a second pressing member located outside of said heat generating member; and biasing means for biasing at least one of said first and second pressing members toward the other to thereby urge said heat generating member against said first pressing member or said second pressing member;

wherein at least one of said first and second pressing members is formed with recesses in at least a part thereof; and wherein each center line of each recess has a maximum rotational angle, as measured in a circumferential direction of said heat insulating member, greater than or equal to an angle of the recess.

28. A device as claimed in claim 27, wherein said first pressing member comprises a freely rotatable roller.

29. A device as claimed in claim 28, wherein said roller has a hollow cylindrical configuration.

30. A thermal fixing device comprising:

a hollow heat generating member comprising at least a heat-generating layer;

a first pressing member disposed in said heat generating member a second pressing member located outside of said heat generating member; and biasing means for biasing at least one of said first and second pressing members toward the other to thereby urge said heat generating member against said first pressing member or said second pressing member;

wherein at least one of said first and second pressing members is formed with recesses in at least a part thereof; and wherein an open end of each of said recesses has a width, as measured in a section perpendicular to an axial direction of said pressing member, smaller than or equal to a nip width defined between said heat generating member and said second pressing member.

31. A device as claimed in claim 30, wherein said first pressing member comprises a freely rotatable roller.

32. A device as claimed in claim 30, wherein said roller has a hollow cylindrical configuration.

33. A thermal fixing device comprising:

a hollow heat generating member comprising at least a heat-generating layer;

a first pressing member disposed in said heat generating member;

a second pressing member located outside of said heat generating member;

biasing means for biasing at least one of said first and second pressing members toward the other to thereby urge said heat generating member against said first pressing member or said second pressing member; and a heat insulating member interposed between said first pressing member and said heat generating member, and comprising a heat insulating layer lower in thermal conductivity than said first pressing member; and wherein at least one of said heat insulating member, said first pressing member and said second pressing member is formed with recesses in at least a part thereof;

wherein center lines of said recesses extend spirally.

34. A device as claimed in claim 33, wherein said first pressing member comprises a freely rotatable roller.

35. A device as claimed in claim 34, wherein said roller has a hollow cylindrical configuration.

36. A device as claimed in claim 33, wherein said heat insulating member has a hollow cylindrical configuration, said first pressing member being disposed in said heat insulating member.

37. A device as claimed in claim 33, wherein said heat insulating member is rigid.

38. A device as claimed in claim 34, wherein said heat insulating member and said first pressing member are constructed integrally with each other.

39. A device as claimed in claim 33, wherein one of said first pressing member and said heat insulating member contacting said heat generating member has, at an intermediate portion, an outside diameter greater than an outside diameter of said first pressing member or said heat insulating member as measured at end portions of said heat generating member.

40. A device as claimed in claim 39, wherein a difference between a diameter of said intermediate portion of said first pressing member or said heat insulating member and a diameter of said first pressing member or said heat insulating member as measured at said end portions of said heat generating member is greater than 0.05 mm.

41. A device as claimed in claim 33, wherein one of said first pressing member and said heat insulating member directly contacting said heat generating member contacts said heat generating member at a plurality of portions spaced in an axial direction thereof.

42. A device as claimed in claim 33, wherein said heat insulating member has a length greater than or equal to a length of said pressing member.

43. A device as claimed in claim 42, wherein the length of said heat insulating member is smaller than or equal to a length of said heat generating member.

44. A thermal fixing device comprising:

a hollow heat generating member comprising at least a heat-generating layer;

a first pressing member disposed in said heat generating member;

a second pressing member located outside of said heat generating member;

biasing means for biasing at least one of said first and second pressing members toward the other to thereby urge said heat generating member against said first pressing member or said second pressing member; and a heat insulating member interposed between said first pressing member and said heat generating member, and comprising a heat insulating layer lower in thermal conductivity than said first pressing member; and wherein at least one of said heat insulating member, said first pressing member and said second pressing member is formed with recesses in at least a part thereof;

wherein each center line of each recess has a maximum rotational angle, as measured in a circumferential direction of said heat insulating member, greater than or equal to an angle of the recess.

45. A device as claimed in claim 44, wherein said first pressing member comprises a freely rotatable roller.

46. A device as claimed in claim 45, wherein said roller has a hollow cylindrical configuration.

47. A device as claimed in claim 44, wherein said heat insulating member has a hollow cylindrical configuration, said first pressing member being disposed in said heat insulating member.

48. A device as claimed in claim 44, wherein said heat insulating member is rigid.

49. A device as claimed in claim 45, wherein said heat insulating member and said first pressing member are constructed integrally with each other.

50. A device as claimed in claim 44, wherein one of said first pressing member and said heat insulating member contacting said heat generating member has, at an intermediate portion, an outside diameter greater than an outside diameter of said first pressing member or said heat insulating member as measured at end portions of said heat generating member.

51. A device as claimed in claim 50, wherein a difference between a diameter of said intermediate portion of said first pressing member or said heat insulating member and a diameter of said first pressing member or said heat insulating member as measured at said end portions of said heat generating member is greater than 0.05 mm.

52. A device as claimed in claim 44, wherein one of said first pressing member and said heat insulating member directly contacting said heat generating member contacts said heat generating member at a plurality of portions spaced in an axial direction thereof.

53. A device as claimed in claim 44, wherein said heat insulating member has a length greater than or equal to a length of said pressing member.

54. A device as claimed in claim 53, wherein the length of said heat insulating member is smaller than or equal to a length of said heat generating member.

55. A thermal fixing device comprising:

a hollow heat generating member comprising at least a heat-generating layer;

a first pressing member disposed in said heat generating member;

a second pressing member located outside of said heat generating member;

biasing means for biasing at least one of said first and second pressing members toward the other to thereby urge said heat generating member against said first pressing member or said second pressing member; and a heat insulating member interposed between, said first pressing member and said heat generating member, and comprising a heat insulating layer lower in thermal conductivity than said first pressing member; and wherein an open end of each of said recesses has a width, as measure in a section perpendicular to an axial direction of said pressing member, smaller than or equal to a nip width defined between said heat generating member and said second pressing member.

56. A device as claimed in claim 55, wherein said first pressing member comprises a freely rotatable roller.

57. A device as claimed in claim 56, wherein said roller has a hollow cylindrical configuration.

58. A device as claimed in claim 55, wherein said heat insulating member has a hollow cylindrical configuration, said first pressing member being disposed in said heat insulating member.

59. A device as claimed in claim 55, wherein said heat insulating member is rigid.

60. A device as claimed in claim 56, wherein said heat insulating member and said first pressing member are constructed integrally with each other.

61. A device as claimed in claim 55, wherein one of said first pressing member and said heat insulating member contacting said heat generating member has, at an intermediate portion, an outside diameter greater than an outside diameter of said first pressing member or said heat insulating member as measured at end portions of said heat generating member.

62. A device as claimed in claim 61, wherein a difference between a diameter of said intermediate portion of said first pressing member or said heat insulating member and a diameter of said first pressing member or said heat insulating member as measured at said end portions of said heat generating member is greater than 0.05 mm.

63. A device as claimed in claim 55, wherein one of said first pressing member and said heat insulating member directly contacting said heat generating member contacts said heat generating member at a plurality of portions spaced in an axial direction thereof.

64. A device as claimed in claim 55, wherein said heat insulating member has a length greater than or equal to a length of said pressing member.

65. A device as claimed in claim 64, wherein the length of said heat insulating member is smaller than or equal to a length of said heat generating member.

66. A thermal fixing device comprising:

a hollow heat generating member comprising at least a heat-generating layer;

a first pressing member disposed in said heat generating member;

a second pressing member located outside of said heat generating member; and biasing means for biasing at least one of said first and second pressing members toward the other to thereby urge said heat generating member against said first pressing member or said second pressing member;

a heat insulating member interposed between said first pressing member and said heat generating member, and comprising a heat insulating layer lower in thermal conductivity than said first pressing member; and wherein one of said first pressing member and said heat insulating member contacting said heat generating member has, at an intermediate portion, an outside diameter greater than an outside diameter of said first pressing member or said heat insulating member as measured at end portions of said heat generating member.

67. A device as claimed in claim 66, wherein said first pressing member comprises a freely rotatable roller.

68. A device as claimed in claim 67, wherein said roller has a hollow cylindrical configuration.

69. A device as claimed in claim 66, wherein said heat insulating member has a hollow cylindrical configuration, said first pressing member being disposed in said heat insulating member.

70. A device as claimed in claim 69, wherein said heat insulating member is rigid.

71. A device as claimed in claim 70, wherein said heat insulating member and said first pressing member are constructed integrally with each other.

72. A device as claimed in claim 66, wherein said heat insulating member is formed with one of recesses and holes.

73. A device as claimed in claim 72, wherein said recesses extend linearly.

74. A device as claimed in claim 72, wherein center lines of said recesses extend spirally.

75. A device as claimed in claim 72, wherein each of center lines of said recesses has a maximum rotation angle, as measured in a circumferential direction of said heat insulating member, greater than or equal to a width of the recess.

76. A device as claimed in claim 66, wherein an open end of each of said spaces has a width, as measured in a section perpendicular to an axial direction of said heat insulating member, smaller than or equal to a nip width defined between said heat generating member and said second pressing member.

77. A device as claimed in claim 66, wherein a difference between a diameter of said intermediate portion of said first pressing member or said heat insulating member and a diameter of said first pressing member or said heat insulating member as measured at said end portions of said heat generating member is greater than 0.05 mm.

78. A device as claimed in claim 66, wherein one of said first pressing member and said heat insulating member directly contacting said heat generating member contacts said heat generating member at a plurality of portions spaced in an axial direction thereof.

79. A device as claimed in claim 66, wherein said heat insulating member has a length greater than or equal to a length of said pressing member.

80. A device as claimed in claim 66, wherein the length of said heat insulating member is smaller than or equal to a length of said heat generating member.

81. A thermal fixing device comprising:

a hollow heat generating member comprising at least a heat-generating layer;

a first pressing member disposed in said heat generating member;

a second pressing member located outside of said heat generating member; and biasing means for biasing at least one of said first and second pressing members toward the other to thereby urge said heat generating member against said first pressing member or said second pressing member; and a heat insulating member interposed between said first pressing member and said heat generating member, and comprising a heat insulating layer lower in thermal conductivity than said first pressing member; and wherein one of said first pressing member and said heat insulating member directly contacting said heat generating member contacts said heat generating member at a plurality of portions spaced in an axial direction thereof.

82. A device as claimed in claim 81, wherein said first pressing member comprises a freely rotatable roller.

83. A device as claimed in claim 82, wherein said roller has a hollow cylindrical configuration.

84. A device as claimed in claim 81, wherein said heat insulating member has a hollow cylindrical configuration, said first pressing member being disposed in said heat insulating member.

85. A device as claimed in claim 84, wherein said heat insulating member is rigid.

86. A device as claimed in claim 85, wherein said heat insulating member and said first pressing member are constructed integrally with each other.

87. A device as claimed in claim 81, wherein said heat insulating member is formed with one of recesses and holes.

88. A device as claimed in claim 87, wherein said recesses extend linearly.

89. A device as claimed in claim 87, wherein center lines of said recesses extend spirally.

90. A device as claimed in claim 87, wherein each of center lines of said recesses has a maximum rotation angle, as measured in a circumferential direction of said heat insulating member, greater than or equal to a width of the recess.

91. A device as claimed in claim 85, wherein an open end of each of said spaces has a width, as measured in a section perpendicular to an axial direction of said heat insulating member, smaller than or equal to a nip width defined between said heat generating member and said second pressing member.

92. A device as claimed in claim 85, wherein a difference between a diameter of said intermediate portion of said first pressing member or said heat insulating member and a diameter of said first pressing member or said heat insulating member as measured at said end portions of said heat generating member is greater than 0.05 mm.

93. A device as claimed in claim 85, wherein said heat insulating member has a length greater than or equal to a length of said pressing member.

94. A device as claimed in claim 85, wherein the length of said heat insulating member is smaller than or equal to a length of said heat generating member.

* * * * *